US009045878B2

(12) United States Patent
Henderson

(10) Patent No.: US 9,045,878 B2
(45) Date of Patent: Jun. 2, 2015

(54) CEMENTITIOUS FOUNDATION CAP WITH POST-TENSIONED HELICAL ANCHORS

(71) Applicant: Allan P. Henderson, Bakersfield, CA (US)

(72) Inventor: Allan P. Henderson, Bakersfield, CA (US)

( * ) Notice: Subject to any disclaimer, the term of this patent is extended or adjusted under 35 U.S.C. 154(b) by 0 days.

(21) Appl. No.: 14/257,530

(22) Filed: Apr. 21, 2014

(65) Prior Publication Data

US 2014/0223846 A1 Aug. 14, 2014

Related U.S. Application Data

(62) Division of application No. 13/435,527, filed on Mar. 30, 2012, now Pat. No. 8,720,139.

(51) Int. Cl.

| | |
|---|---|
| ***E02D 27/32*** | (2006.01) |
| ***E02D 27/42*** | (2006.01) |
| ***E02D 5/80*** | (2006.01) |
| ***E02D 27/00*** | (2006.01) |
| ***E04C 5/12*** | (2006.01) |

(52) U.S. Cl.

CPC ..... *E02D 27/425* (2013.01); *E02D 5/80* (2013.01); *E02D 27/00* (2013.01); *E02D 27/32* (2013.01); *E02D 27/42* (2013.01); *E04C 5/125* (2013.01)

(58) Field of Classification Search

CPC ..... E02D 27/425; E02D 27/32; E02D 27/42; E02D 27/50; E02D 5/80; E04C 5/125

USPC ..... 52/296, 295, 157, 223, 297; 405/229, 405/230, 231

See application file for complete search history.

(56) References Cited

U.S. PATENT DOCUMENTS

| | | | | |
|---|---|---|---|---|
| 4,068,445 | A * | 1/1978 | Bobbitt | 52/741.11 |
| 5,586,417 | A | 12/1996 | Henderson et al. | |
| 5,826,387 | A | 10/1998 | Henderson et al. | |
| 5,919,005 | A * | 7/1999 | Rupiper | 405/244 |
| 6,058,662 | A * | 5/2000 | Perko | 52/157 |
| 6,615,554 | B2 * | 9/2003 | Rupiper | 52/157 |
| 6,665,990 | B1 * | 12/2003 | Cody et al. | 52/295 |
| 6,672,023 | B2 * | 1/2004 | Henderson | 52/296 |
| 6,672,823 | B2 | 1/2004 | Henning | |
| 6,722,821 | B1 * | 4/2004 | Perko et al. | 405/249 |
| 7,097,388 | B1 * | 8/2006 | Mansour et al. | 405/230 |
| 7,241,079 | B2 * | 7/2007 | Francis | 405/231 |
| 7,533,505 | B2 * | 5/2009 | Henderson | 52/292 |
| 7,618,217 | B2 * | 11/2009 | Henderson | 405/255 |
| 7,707,797 | B2 * | 5/2010 | Henderson | 52/745.17 |
| 2007/0286686 | A1 * | 12/2007 | Lindsey | 405/233 |
| 2011/0036025 | A1 * | 2/2011 | Boulay | 52/157 |
| 2012/0260592 | A1 * | 10/2012 | Wolf | 52/296 |

* cited by examiner

*Primary Examiner* — Brian Glessner
*Assistant Examiner* — Paola Agudelo
(74) *Attorney, Agent, or Firm* — Jacobson Holman, PLLC.

(57) ABSTRACT

A post-tensioned concrete cap foundation has helical anchors with pipes having several helical discs welded around the pipe perimeter to spin drill deep into subsurface soils or other soft materials with holes in the pipe for high pressure-grouting in place. The helical anchor pipes include a tensioning element for pulling and post-tensioning the helical anchor. The helical anchors are tension anchors which can be converted to compression anchors. The helical anchors in tension serve to pull the foundation cap down to compress the underlying soil while the compression anchors limit the maximum settlement of the concrete foundation cap. The foundation also includes perimeter-forming and interior corrugated metal pipes with upper and lower sleeved horizontally extending radial bolts that are secured to the pipes and post-tensioned to provide lateral foundation compression.

22 Claims, 14 Drawing Sheets

CEMENTITIOUS FOUNDATION CAP WITH POST-TENSIONED HELICAL ANCHORS

This application is a divisional application of U.S. application Ser. No. 13/435,527, filed Mar. 30, 2012, and hereby claims the priority thereof to which this application is entitled.

BACKGROUND OF THE INVENTION

1. Field of the Invention

This invention relates in general to concrete support foundations constructed in-situ particularly useful for supporting tall, heavy or large towers which may be used to support wind turbines, power lines, street lighting and signals, bridge supports, commercial signs, freeway signs, ski lifts and the like. More specifically, the helical anchor foundation of the present invention is useful in supporting such towers in clays, sands, and other soft materials which can be water-bearing and/or too weak to stand or maintain the excavations formed to receive a concrete foundation. Such soils can be found in the Midwest region and coastal regions of North America.

2. Description of Related Art

My earlier U.S. Pat. No. 5,586,417 for tensionless pier foundation, U.S. Pat. No. 5,826,387 for pier foundation under high unit compression, U.S. Pat. No. 6,672,823 for perimeter weighted foundation, U.S. Pat. No. 7,533,505 for pile anchor foundation, U.S. Pat. No. 7,618,217 for post tension pile foundation, and U.S. Pat. No. 7,707,797 (the '797 patent) for pile anchor foundation disclose post-tension concrete foundations for tower structures, the disclosures of which are expressly incorporated herein by reference as if fully set forth in their entirety. The prior art cited in these patents may also be relevant to the post-tensioned helical anchor and foundation cap of the present invention.

The foundation disclosed in the '797 patent has a circular post-tensioned concrete can set on or below ground surface. The foundation supports a tower from the upper surface thereof, which tower is attached to the post-tensioned concrete cap by a series of circumferentially spaced tower anchor bolts. The tower anchor bolts extend upwardly through, and are nutted atop, a circular tower base flange at the bottom of the tower and extend downwardly through, and nutted below, an embedment ring near the bottom of the post-tensioned concrete cap. The tower anchor bolts are also sleeved and shielded so as to prevent the concrete from bonding to the anchor bolts. This structure allows the tower anchor bolts to be elongated and post-stressed between the tower base flange and the embedment ring to alleviate bolt cycling and fatigue and allow the tower anchor bolts to be removed and replaced for bolt remediation, extended fatigue life, and greater bolt strength capacity to allow larger improved structures to be supported by the foundation in the future.

In a conventional helical foundation, the helical anchors are elongated pipes which extend upwardly into and connect to an overlying concrete foundation cap and are both compression and tension resisting foundation extensions which alternate between tension and compression as the foundation moves in a rocking fashion. The helical anchor pipes in such foundations are not connected to tensioning bolts and are not post-tensioned.

SUMMARY OF THE INVENTION

The concrete foundation according to the present invention resists supported tower overturn by utilizing a multitude of circumferentially spaced, post-tensioned helical anchors, sometimes more simply referred to herein as helical anchors. Each of the post-tensioned helical anchors is in the nature of an elongated pipe with spaced helical discs assembled around the periphery thereof which allow the lower portion of the helical anchor to be spin-drilled deep into the ground, as is known in the art. The upper end of each post-tensioned helical anchor includes a post-tensioning element, sometimes more simply referred to herein as a tensioning element, which extends upwardly through the concrete foundation can once poured and cured. The helical anchors are capable of being post-tensioned against the top of the foundation cap after the cap has cured.

To this end, the tensioning element at the upper end of the helical anchor is encased, preferably with a plastic sleeve or the like. The encasing ensures that the tensioning element of the helical anchor does not bond to or bear into the foundation concrete cap, thus allowing the helical anchor to be post-tensioned and pulled upwardly until the helical disc and skin friction resistance of the in-ground helical anchor with the surrounding subsurface soils equals the required tension applied to the helical anchor. The required post-tension applied to the tensioning element should exceed the maximum uplift load determined for each helical anchor. Therefore, unlike conventional helical anchors, the helical anchors of the present invention are post-tensioned anchors resisting overturn uplift.

In another aspect of the present invention, the lower portion of the post-tensioned helical anchor has grout holes in the pipe walls. Thus, once the helical anchor has been positioned into the ground, grout can be injected under pressure into the top of the anchor at the ground surface to fill the pipe and then be forced into the surrounding soil through the grout holes. As such, the post-tensioned helical anchors can be pressure grouted around their perimeter with cementitious material after the post-tensioned helical anchor has been spin-drilled into its desired position in the ground.

Two embodiments of the post-tensioned helical anchors for use in accordance with the present invention are disclosed herein. In both embodiments, the portion of the post-tensioned helical anchor which is spin-drilled and positioned in the ground is referred to herein as the "helical anchor pipe" or simply the "anchor pipe".

In the first embodiment, each of the helical anchors includes an elongated pipe with spaced helical discs assembled around the perimeter thereof, together with a post-tensioning element, such as a tendon, or elongated bolt, coupled to the upper end of the elongated pipe by a connecting subassembly. These helical anchors are referred to herein as "bolt helical anchors". The tensioning element is in the form of a tendon or bolt, referred to generally herein as "anchor tendons" or "anchor bolts" with both terms being intended to be interchangeable. Further, as used herein, the terms "helical anchor bolts" or "helical anchor tendons" are understood to refer to the bolts or tendons in the helical anchors, as the bolts and tendons themselves are not helical.

The helical anchor bolts extend through the foundation cap and are encased in a plastic sleeve to prevent bonding between the tensioning elements and the cementitious material of the cap. The upper end of the tendon or bolt is threaded and equipped with a post-tensioning nut threaded thereon to post-tension the helical anchor after the cementitious material of the concrete foundation cap has cured and hardened. The tension in the upper end of the anchor tendon, preferably embodied as a bolt having a length of less than about 10 feet, can be measured with an ultrasonic device, eliminating the need and expense of periodically retensioning the bolt for possible relaxation.

The elongated pipe section, or helical anchor pipe, of the bolt helical anchors, extends downwardly from about 40 feet to about 100 feet or more into the ground, depending on the type of soil surrounding the foundation, and can be made up of several pipe sections connected end-to-end.

In the second alternative embodiment, each post-tensioned helical anchor comprises a plurality of cylindrical hollow bars or anchor rods that are interconnected end-to-end. These helical anchors are sometimes referred to herein as "hollow bar helical anchors". The hollow bar helical anchors are made up of externally threaded pipes, typically up to 20 feet in length. In order to form the hollow bar helical anchors, the hollow bars are coupled together longitudinally with an internally threaded coupler on which is externally mounted one or more helical discs which serve to spin-drill the hollow bar helical anchor into the ground. The hollow bar helical anchors do not require separate anchor tendons or bolts as in the first embodiment because the uppermost hollow bar can serve as the tensioning element. The length of the uppermost hollow bar which extends through the foundation cap is sleeved to allow the hollow bar helical anchor to be post-tensioned directly and nutted above the foundation cap. Grout holes are provided in the hollow bar couplers and/or hollow bars so that the hollow bar helical anchors can also be pressure grouted around their perimeter once spin-drilled into the ground.

Accordingly, the foundation of this invention allows pole and tower structure foundation caps to be constructed at or below ground surface in weaker shallow water-bearing soils or materials susceptible to sidewall caving when excavated. The foundation of this invention is intended to resist long term dynamic loading, minimize movement, provide high rotational stiffness, and greater fatigue resistance.

In addition to having tension-only, post-tensioned helical anchors, the present invention also includes post-tensioned helical anchors that can be converted to serve as both tension and load bearing compression anchors, generally referred to herein as convertible helical anchors, to limit the maximum settlement of the concrete foundation cap. Both embodiments of post-tensioned helical anchors disclosed herein, i.e., the bolt helical anchors and the hollow bar helical anchors, may be constructed as convertible helical anchors.

The convertible helical anchors terminate below the concrete foundation cap with a gap, preferably filled with a compressible material such as a disc made of Styrofoam or the like, immediately below the concrete foundation cap, in accordance with the teachings of my aforesaid '797 patent. While the compressible material is generally referred to as a "disc", other shapes and other compressible materials may be used. The compressible disc allows the concrete cap foundation to be pulled downwardly, compressing and consolidating the underlying soils to the required bearing strengths and allowing the helical anchors to pull upwardly, developing the skin friction resistance equal to the helical anchor post-tension.

The base flange of the tower is set in grout inside a grout trough molded by a template ring around the top surface of the foundation cap. The tower may be plumbed vertically by shim packs positioned in the grout trough below the lower base flange while grout is poured or pumped into the grout trough under the tower base flange and cured.

Electrical, grounding, and communication conduits are positioned in and through, or under, the concrete foundation cap to allow wiring and conductors to be pulled into the tower. Electrical grounding cables connect the above ground supported structure to cables and rods beyond the perimeter of the concrete foundation cap. Internal electrical grounding cables connect to the corrugated metal pipe (described hereinafter) and to the helical anchor pipes.

In addition to having post-tensioned helical anchors which extend generally in a vertical direction, the foundation according to the present invention replaces conventional lateral reinforcement provided by steel rebar bonding to the foundation cap concrete, with nutted and sleeved radial bolts. The radial bolts are positioned to be generally horizontal and to extend laterally between at least an inner corrugated pipe embedded vertically in the foundation cap and an outer vertical corrugated pipe which preferably defines the outer perimeter of the foundation cap. The corrugated pipes provide vertical steel reinforcement around the perimeter of the post-tensioned concrete cap and internally therein.

Two sets of radial bolts extend radially and horizontally through the concrete foundation cap, one set near the top and one set near the bottom of the cap. Both sets of radial bolts are positioned and aligned by holes in the corrugated pipes or the like. The radial bolts or tendons preferably extend horizontally beyond the outer, perimeter-defining corrugated pipe and can be post-tensioned by hydraulic lacks or other torquing devices and are generally held post-tensioned by nuts. Post-tensioning of the horizontal radial bolts or tendons is facilitated by sleeving or otherwise isolating the bolts from the surrounding cementitious material of the concrete cap, in the same manner as previously disclosed for post-tensioned vertical bolts in my aforesaid prior patents.

The post-tensioned radial bolts or tendons compress the foundation concrete laterally, stiffening the foundation to provide greater resistance to cyclic bending forces from the supported dynamic structure and increased fatigue resistance. The radial bolts or tendons can also be removed and replaced for extending fatigue life, remediation, and replacement with bolts of greater strength. Also, when the radial bolts extend horizontally beyond the perimeter of the foundation, the extensions allow coupling on of additional bolt extensions in order to enlarge the diameter of the foundation cap which, in turn, increases the capacity of the foundation support for larger structures with greater loading using the original base foundation.

As already noted above, both embodiments of the post-tensioned helical anchors are preferably provided with grout holes and pressure-grouted around their perimeter with cementitious material after the anchor pipes have been spin drilled to the desired position in the ground. The pressure grouting is completed before the foundation cap is formed in the case of the bolt helical anchors. On the other hand, because the hollow bars of the hollow bar helical anchors extend all the way through the foundation cap, the hollow bar helical anchors can be pressure-grouted either before or after the foundation cap has been formed. In either case, the top of the helical anchor pipe immediately below the bottom of the concrete foundation cap is generally not grouted so as to facilitate the post-tensioning of the helical anchors. By pressure-grouting the helical anchor pipes around their perimeter, the helical anchor pipes can be better stabilized in the ground soil, especially in weaker shallow water-bearing soils or materials.

In another aspect of the present invention, a movable packer can be employed in the helical anchor pipe in order to isolate specific sections of the helical anchor pipe for pressure-grouting around a portion of the pipe perimeter. Typically, the pressure-grouting around the pipe perimeter begins at the lowermost portion of the helical anchor pipe with the desired portion to be pressurized sealed at the top by the movable packer. Once the first lowermost portion of the helical pipe has been pressure-grouted inside and around its perimeter, the movable packer can be moved upwardly to the next portion to be isolated for the pressure-grouting.

In another preferred embodiment of the present invention, energy-dampening grout can be used in the grout trough when stabilizing the tower base flange after leveling. Such grout may include rubber-tire grindings and/or fiber mesh as supplemental aggregate or the like.

In accordance with the foregoing, it is an object of the present invention to provide vertically and horizontally post-tensioned concrete foundation having a reinforced concrete foundation cap for supporting dynamic tall, heavy, and/or large towers and/or poles which can be constructed in-situ and is especially useful in supporting such towers in clays, sands, soft rocks bearing shallow ground water and other bearing soils that are too weak to stand or maintain dimensions of an excavation formed to receive a concrete foundation.

A further object of the present invention is to provide a vertically and horizontally post-tensioned concrete supporting foundation in accordance with the preceding object in which the vertical post-tensioning structure includes a plurality of circumferentially spaced post-tensioned helical anchors, each helical anchor including a helical anchor pipe with external helical discs and a tensioning element extending up through the concrete foundation cap and above the top surface thereof, for post-tensioning the helical anchors and pulling the concrete foundation cap downwardly to compress the underlying bearing soils.

Yet a further object of the present invention is to provide a vertically and horizontally post-tensioned concrete supporting foundation in accordance with the preceding objects in which the tensioning element is either a solid bolt or tendon connected to the top of a helical anchor pipe of a bolt helical anchor, or a short length of hollow bar or anchor rod at the top of a hollow bar helical anchor, both of which extend through the concrete foundation cap and above the top surface thereof.

Still a further object of the present invention is to provide a vertically and horizontally post-tensioned concrete supporting foundation in accordance with the preceding objects in which the bolts or tendons of the bolt helical anchors, and/or the upper portion of the hollow bar helical anchors, are provided with plastic sleeves or the like to prevent bonding with the concrete in the leveling course and the concrete foundation cap, facilitating post-tensioning of the helical anchors and eliminating stress reversals and fatigue while the bolts or hollow rods are stretched by jacking or torquing during the post-tensioning.

Yet another object of the present invention is to provide a vertically and horizontally post-tensioned concrete supporting foundation in accordance with the preceding objects in which the post-tensioned helical anchors are tension anchors but can also be provided with compression anchor capabilities to limit the maximum settlement of the concrete foundation cap by adding a steel plate topped with a crushable material. Styrofoam or the like, which allows the concrete foundation cap to be pulled down so the plate contacts the bottom of the concrete foundation cap, limiting additional concrete foundation cap settlement.

A still further object of the present invention is to provide a vertically and horizontally post-tensioned concrete supporting foundation in accordance with the preceding objects in which the horizontal post-tensioning structure includes nutted and sleeved radial bolts that extend horizontally through the concrete foundation cap adjacent its top and bottom surfaces and are post-tensioned after the concrete foundation cap has been poured and cured by tensioning the bolts with a hydraulic jack and torquing the nuts around the perimeter of the concrete foundation cap to secure the tension in the bolts.

Another object of the present invention is to provide corrugated metal pipes both in the interior and around the perimeter of the concrete foundation cap, which corrugated metal pipes provide vertical and circumferential steel reinforcement, a perimeter form for the concrete pour, and holes near the top and bottom that are aligned radially to support and position the radial sleeved bolts for horizontally post-tensioning the concrete foundation cap.

Yet a further object of the present invention is to provide a vertically and horizontally post-tensioned concrete supporting foundation in accordance with the preceding objects in which the horizontal radial bolts extend beyond the perimeter of the concrete foundation cap and enable the coupling of bolt extensions in order to form an enlarged foundation with an increased diameter that can accommodate an enlarging of or a larger supported structure.

Still another object of the present invention is to provide a vertically and horizontally post-tensioned concrete supporting foundation in accordance with the preceding objects in which fatigue life for the concrete foundation cap is extended by a factor of at least 3 to over 100 year's by post-tensioning the horizontal radial sleeved bolts to eliminate stress reversals and cycling of the horizontal steel from dynamic loading by supported wind turbines and the like.

Still a further object of the present invention is to provide a vertically and horizontally post-tensioned concrete supporting foundation in accordance with the preceding objects in which the sleeved helical anchor tendons or bolts and the sleeved horizontal radial bolts may be replaced for any reason including, but not limited to, maintenance and to increase the bolt strength with stronger steel to accommodate an enlarging of or a larger supported structure.

Another object of the present invention is to provide the helical anchor pipes of the post-tensioned helical anchors with external helical discs and pressure-grouting and regrouting capabilities through holes in the helical anchor pipe for ground improvement around the helical anchor pipe, and the helical discs improving the soil strength, increasing the anchor size and improving the bond between the helical anchor pipe and the soil, all to increase the anchor pullout or downward load resistance, thus increasing the foundation loading capacity and stiffness.

A further object of the present invention is to provide a post-tensioned helical anchor in accordance with the preceding object in which the helical anchor pipe has a smooth continuous open annulus to allow a movable packer to be placed therein to isolate certain zones of the helical anchor pipe for pumping measured grout quantities at desired pressures to specific zones around the periphery of the anchor pipe.

Still another object of the present invention is to provide a post-tensioned helical anchor in accordance with the preceding two objects in which the perimeter of the helical anchor pipe is provided with an uneven outer surface to increase grout bonding thereto, the uneven outer surface including threads on the externally threaded pipes of hollow bar helical anchors or spiral and inertia pipe welds around the perimeter of the helical anchor pipe of bolt helical anchors.

Yet another object of the present invention is to provide a helical anchoring system for resisting large supported structure overturning loads which does not require removal of soil and/or subsurface native materials and water by or during construction of such anchor system or require environmental permits for holding ponds or disposal.

A further object of the present invention is to provide a helical anchoring system in accordance with the preceding object in which a smaller foundation is required, thereby reducing the area and materials needed and resulting in a reduced carbon footprint and environmentally conducive advantages.

Yet a further object of the present invention is to provide a tower sway energy-dampening grout in the grout trough and under the tower base flange of a vertically and horizontally post-tensioned concrete foundation, which grout includes rubber tire grindings and/or fiber mesh as supplemental aggregate or the like which is confined in the grout trough by surrounding concrete.

Still a further object the present invention is to provide greater electrical grounding for electrical towers and wind turbines by connecting the tower or wind turbine to the foundation thereto with electrical grounding cables connected internally to the helical anchor pipes and corrugated metal pipes.

Another object of the present foundation is to provide a foundation extending deep into the ground so as to anchor the foundation below the failure of shallow soils, enabling the foundation to withstand such events as storm surges, seismic upset forces, liquefaction, erosion, and flooding.

Other objectives and advantages will become apparent from the following description, taken in connection with the accompanying drawing, within is set forth by way of illustration and example, by embodiments of this invention.

BRIEF DESCRIPTION OF THE DRAWINGS

Other objects, features and advantages of the present invention will be apparent to those skilled in the art upon a reading of this specification including the accompanying drawings. While intending to illustrate the invention, the drawings are not necessarily to scale.

DESCRIPTION OF THE PREFERRED EMBODIMENTS

Although preferred embodiments of the invention are explained in detail, it is to be understood that the invention is not limited in its scope to the details of construction and arrangement of components of this specific embodiment. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 1:
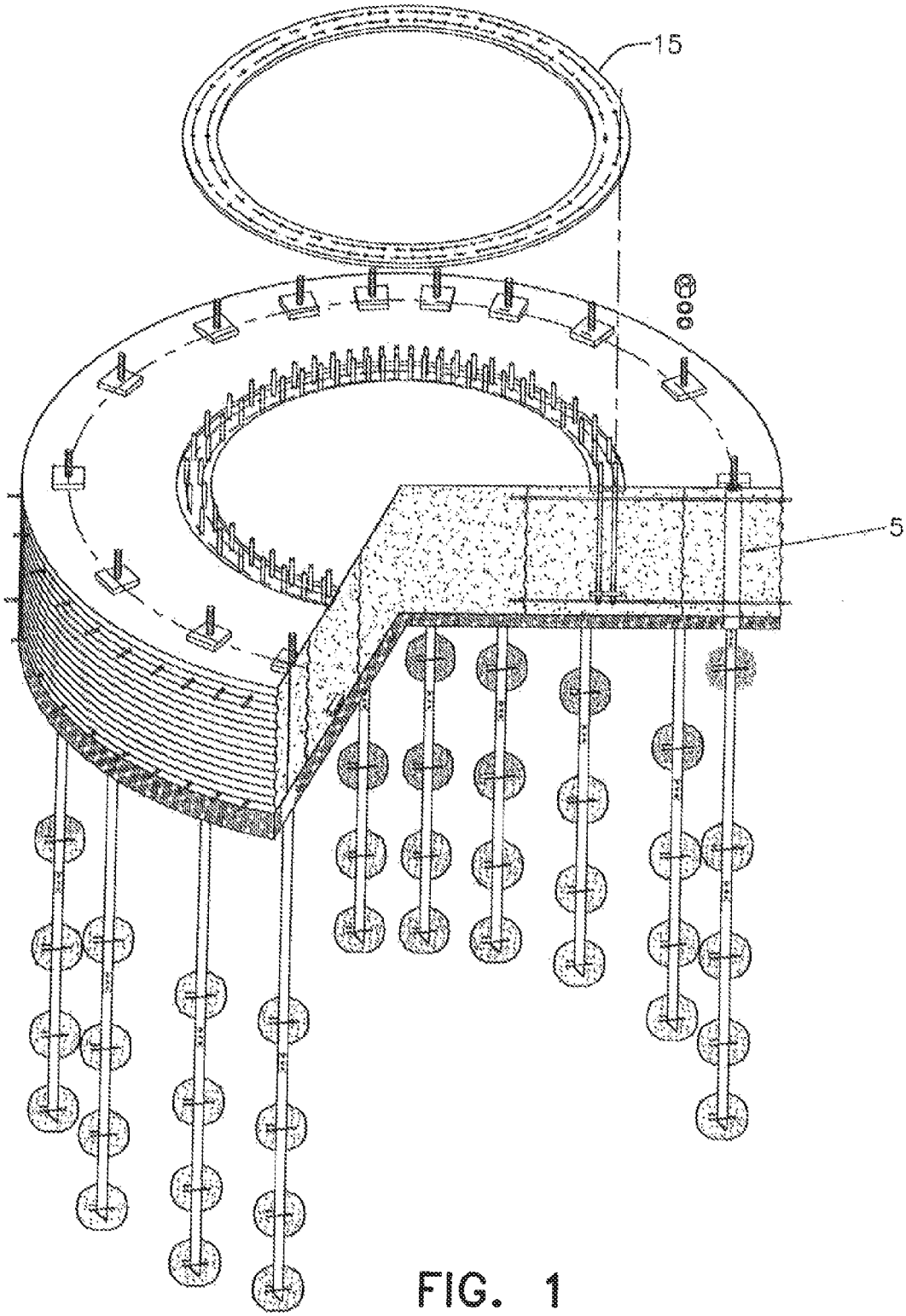
FIG. 1 is a perspective view, partially in section, of a completed concrete foundation with post-tensioned bolt helical anchors and foundation cap constructed in accordance with a first preferred embodiment of the present invention.

Referring to the drawings, FIGS. 1-12 illustrate the overall foundation and specific structures of post-tensioned helical anchors in accordance with a first embodiment of the present invention, i.e., the so-called "bolt helical anchors". As shown in FIGS. 1, 2A and 2B, the foundation of the present invention is generally designated by reference numeral 52. The foundation 52 includes a post-tensioned circular or cylindrical concrete foundation cap, generally designated by reference numeral 46, and a series of circumferentially spaced, post-tensioned bolt helical anchors or helical anchor assemblies, generally designated by reference numeral 47.

Figure 2A:
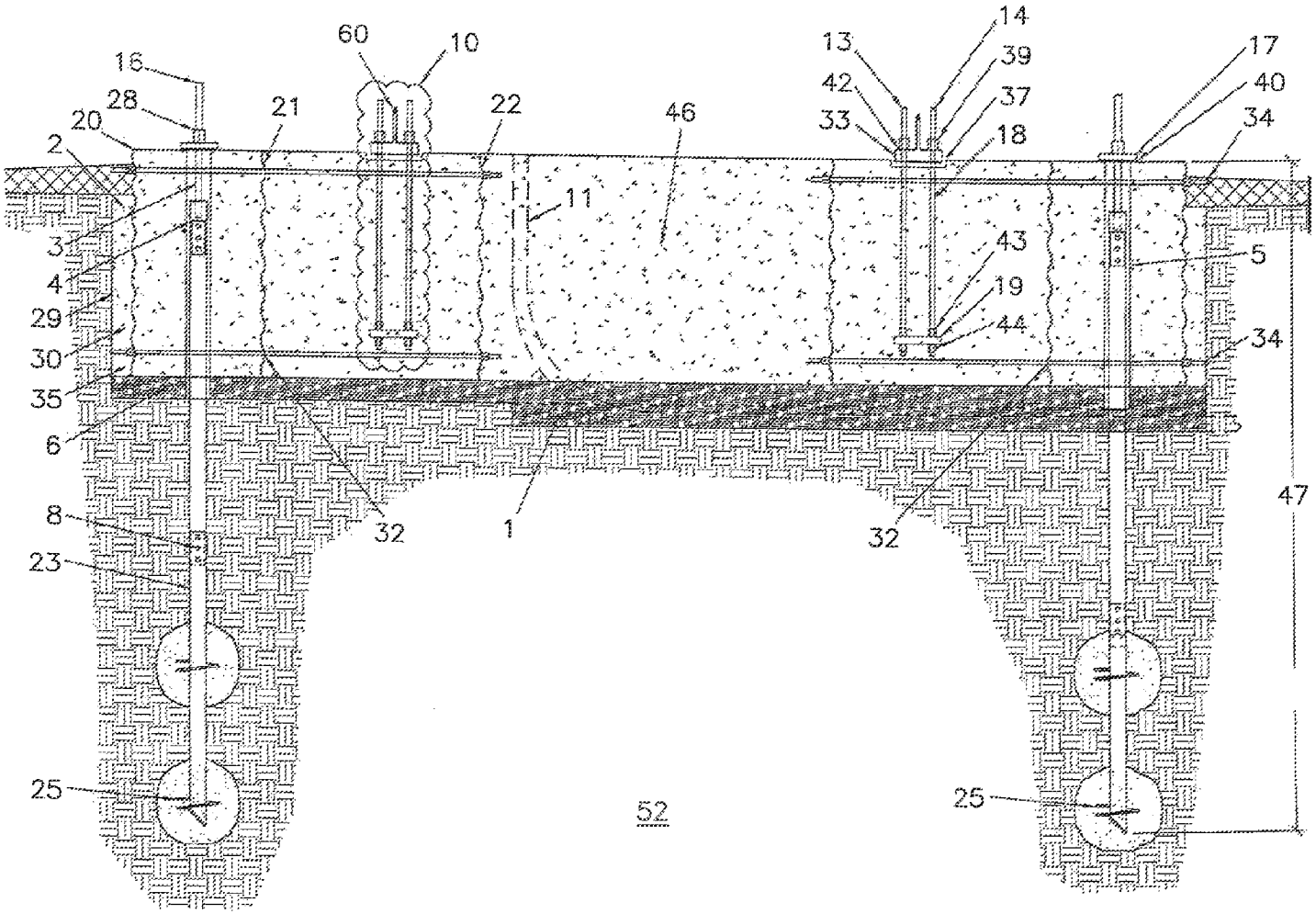
FIG. 2A is a sectional view of the post-tensioned bolt helical anchor and foundation cap with the tower base section flange set in the grout trough, and showing the concrete foundation cap and two tension-only bolt helical anchors in accordance with the first preferred embodiment of the present invention.
Figure 2B:
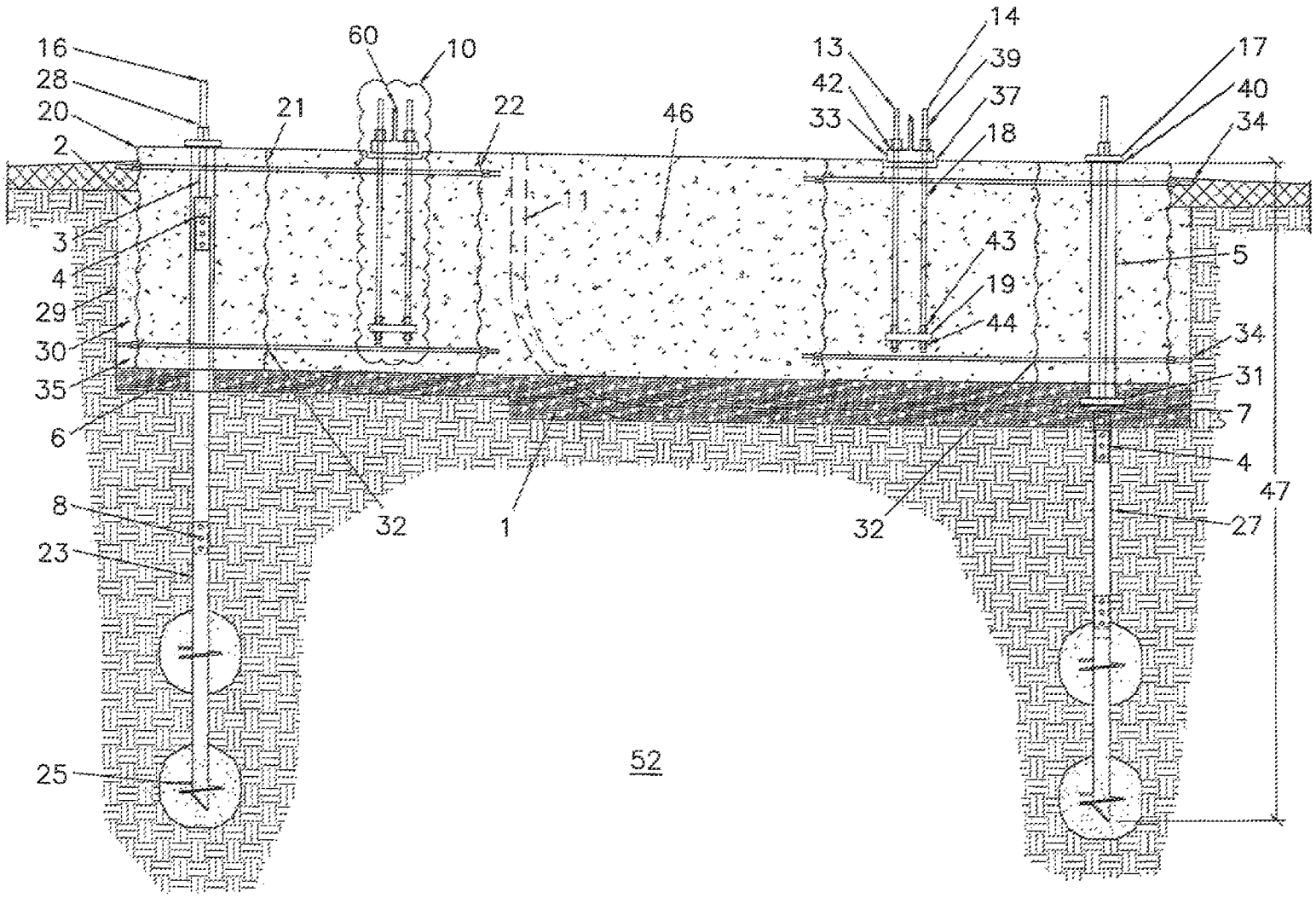
FIG. 2B is a sectional view of the post-tensioned bolt helical anchor and foundation cap with the tower base section flange set in the grout trough, and showing the concrete foundation cap, one tension-only bolt helical anchor and one convertible bolt helical anchor in accordance with the first preferred embodiment of the present invention.

The foundation cap 46 preferably includes an outer upstanding corrugated metal pine (CMP) 20 at its perimeter which may, for example, be 24 feet in diameter and 5 feet in height. The outer CMP 20 is placed atop the ground or in an excavation 29 formed in the ground and resting upon the bottom of the excavation 29 and grout leveling course 1. Referring to FIGS. 2A and 2B, the void 2 between the outer corrugated metal pipe 20 at the concrete foundation cap 46 perimeter and the edge of the excavation 29 is backfilled with clean sand or a sand cement slurry 30.

Figure 3:
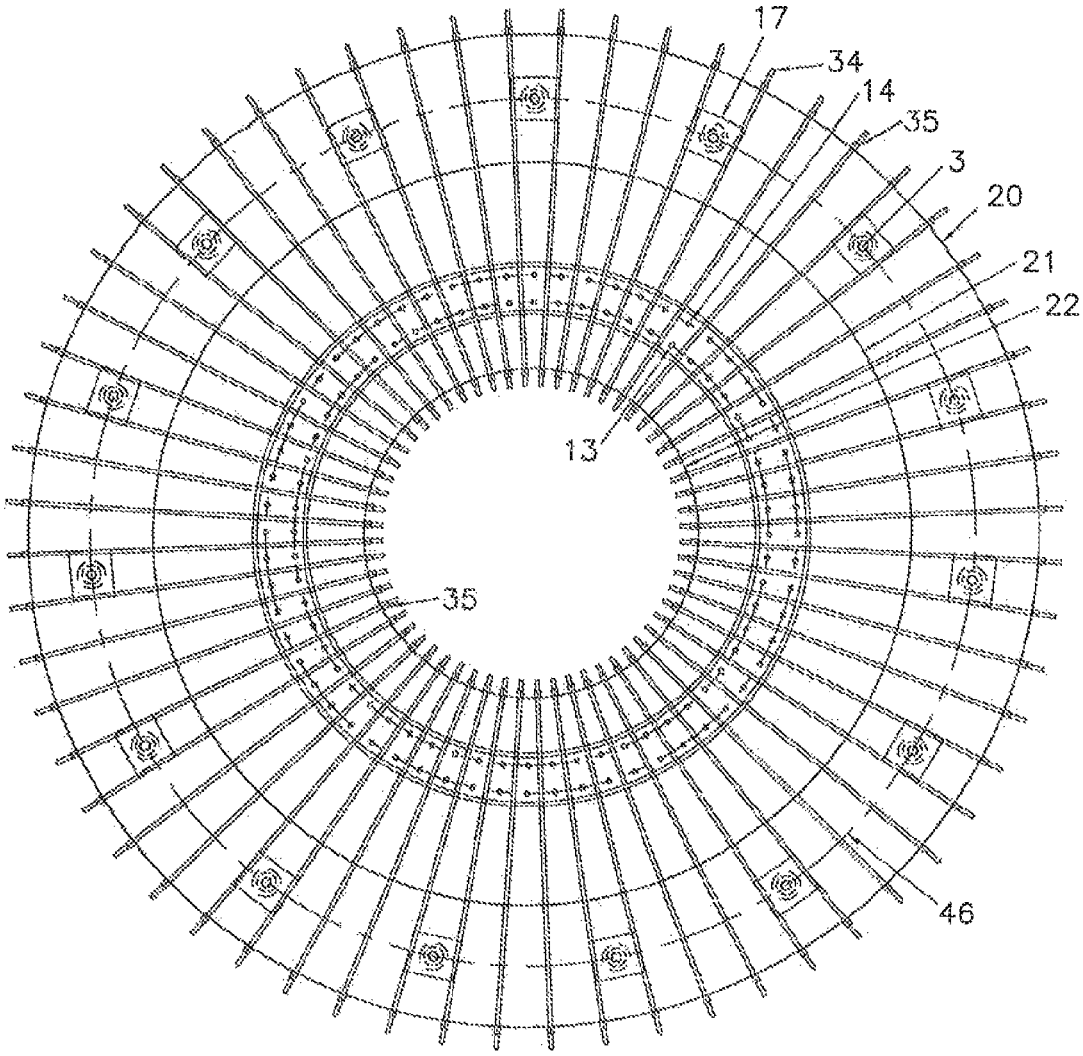
FIG. 3 is a top plan view of the foundation steel components under the template, prior to concrete being poured.
Figure 4:
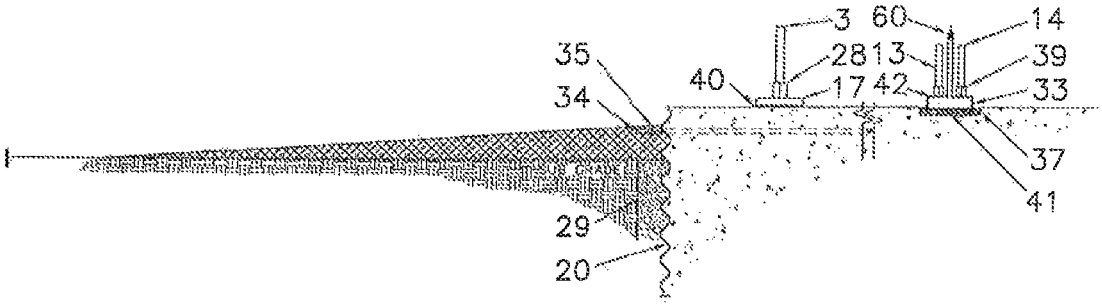
FIG. 4 is an enlarged fragmental view, partly in section, of the completed foundation illustrating an upper end of a bolt helical anchor, the tower anchor bolts and the concrete foundation cap with the tower base flange positioned and grouted atop the foundation.

The concrete foundation cap 46 includes a series of tower anchor bolts 13, 14 spaced circumferentially about the central point of the concrete foundation cap 46 (see FIGS. 2A, 2B and 3). The tower anchor bolts 13, 14 are preferably positioned in radial pairs forming two anchor bolt circles. The inner circle of tower anchor bolts 13 has a slightly smaller diameter than the outer circle of tower anchor bolts 14. For example, the outer tower anchor bolt circle may have a diameter of 14 feet and the inner tower anchor bolt circle may have a diameter of 13 feet. The tower anchor bolts 13, 14 are sleeved, preferably with PVC tubes 18 or the like, which cover the anchor bolts 13, 14 except for threaded portions 39, 42 at the top and bottom of the bolts (see FIGS. 2A, 2B and 5). The anchor bolt sleeves 18, whether made of PVC or other material(s), prevent bonding of the bolts 13, 14 to the concrete and grout.

Figure 5:
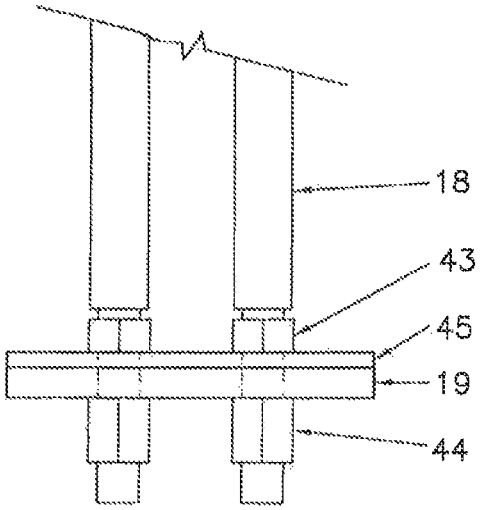
FIG. 5 is an enlarged fragmentary sectional view of the embedment ring at the bottom of the tower anchor bolts illustrating two nuts, PVC sleeve and a splice plate for connecting segments of the embedment ring.

Referring to FIGS. 2A, 2B, 5 and 6, the lower ends of the tower anchor bolts 13 are anchored near the bottom of the concrete foundation cap 46 with an embedment ring 19 which preferably may be constructed of several circular segments lap jointed at 45. The embedment ring 19 is preferably about the same size as and complementary to the tower base flange 33. The ring 19 contains bolt holes 32 for each of the anchor bolts 13, 14. The bolts 13, 14 are secured in the bolt holes 32 by any suitable securement, such as hex nuts 44 below the embedment ring 19 and hex nuts 43 atop the embedment ring as shown in FIG. 5.

Figure 6:
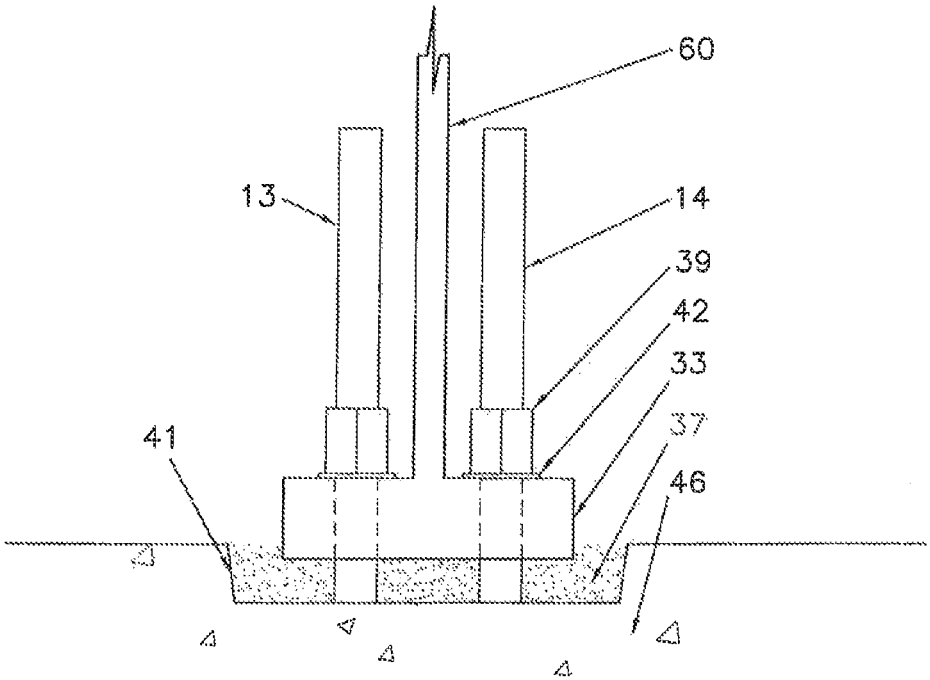
FIG. 6 is an enlarged fragmental view illustrating the top of two post-tensioned tower anchor bolts engaging the tower base flange with the grout filling the grout trough between the top of the concrete foundation cap and the bottom of the tower base flange.
Figure 6A:
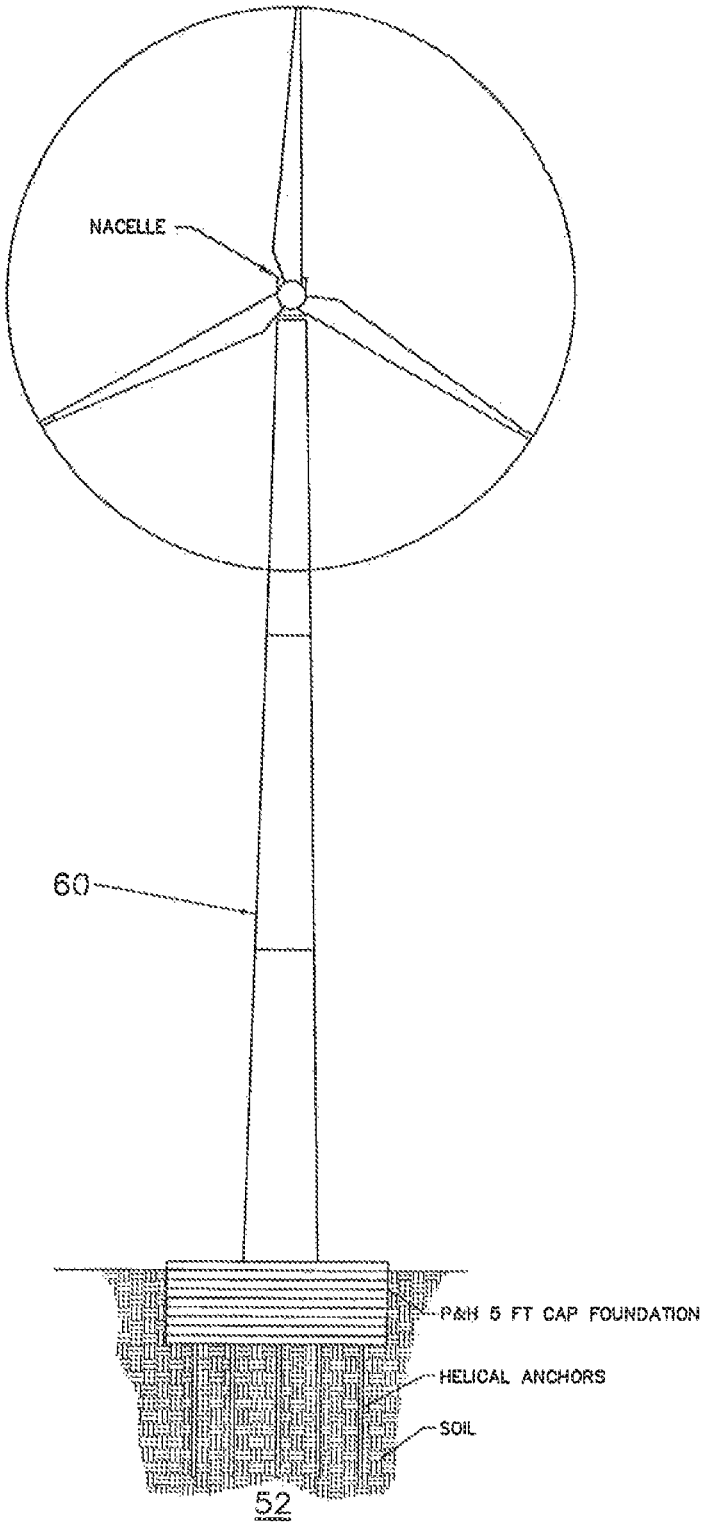
FIG. 6A is a side view of a vertically and horizontally post-tensioned concrete foundation supporting a tower in accordance with the present invention.

FIG. 6 shows the top of a post-tensioned foundation cap 46 with the upper ends of the tower anchor bolts 13 projecting through the tower base flange 33. Tower anchoring hex nuts 39 are threaded onto the tower anchor bolts and the tower 60 (see FIGS. 2A, 2B and 6) which extend upwardly well above the tower base flange. Grout 37, which is poured into the grout trough 41 before placement of the tower and tower base flange, extends under the tower base flange 33 to complete installation of the tower 60.

Figure 11:
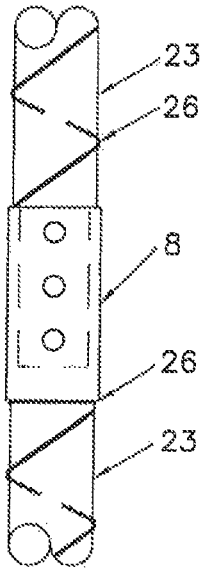
FIG. 11 is an enlarged fragmental view of two lengths of the helical anchor pipe shown in FIG. 9 connected by a coupler and having spiral and inertia rough welds.

FIGS. 1, 2A and 2B show complete views of the bolt helical anchor assemblies 47 with tensioning elements including elongated anchor bolts or anchor tendons according to the first embodiment. Each bolt helical anchor assembly 47 includes a helical anchor pipe 23 with helical discs 25 welded around its perimeter. The helical anchor pipes 23 are sectioned typically in 5 ft. to 20 ft. lengths. The helical anchor pipes 23 are bolted together with bolts or studs through bolted pipe couplers 8 as shown in FIG. 11. The helical discs around the perimeter of the pipe allow the helical anchor to be spin drilled deep into the ground which may include sands, silts, clays, weak rock or combinations thereof to depths of about 40 feet to about 100 feet, or more, as desired.

Post-tensioning helical anchor bolts or tendons 3 are preferably threaded bolts with a nut 28 at the top. The helical anchor bolts 3 are preferably steel rods of grade 75 or 150 and have a diameter on the order of 1.75 inches. The size and grade of the rods may be varied depending upon the load requirements for the foundation.

The helical anchor bolts 3 are connected at their lower end to the helical anchor pipe 23 by a subassembly 4 (see FIGS. 2A, 25, 7, 8 and 8A). The subassembly 4, shown in an enlarged view of FIG. 8A, includes a pipe bolt coupler 64 having a blind bore 65 with inner threads 66 for threaded engagement with the lower end of the anchor bolt 3 of the helical anchor. The pipe bolt coupler is preferably between about 4 inches and about 6 inches in length, with the internal threading extending approximately 75% of the length of the coupler. Preferably, the threaded portion of the anchor bolt is about 3 to 4 inches in length, or roughly twice the diameter of the anchor bolt 3. The pipe bolt coupler 64 is connected at its lower end, preferably by an inertia weld 68, to a rod 70 having holes 72 therein for receiving pipe bolts (not shown). The pipe bolts pass through the holes 72 and through corresponding aligned holes in the top of the anchor pipes 23 to secure the pipes to the subassembly 4.

Figure 7:
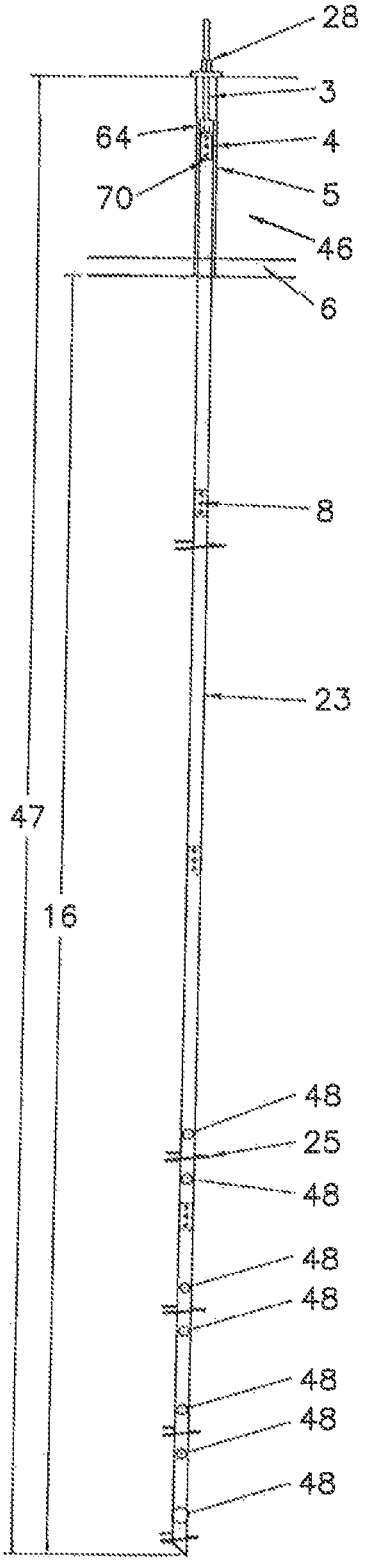
FIG. 7 is a sectional view illustrating a tension-only bolt helical anchor according to the first embodiment with anchor bolts or anchor tendons as the post-tensioning elements, with the upper end extending through the concrete foundation cap and the helical anchor pipe at the lower and made up of coupled pipe sections with helical discs mounted exteriorly thereon.
Figure 8:
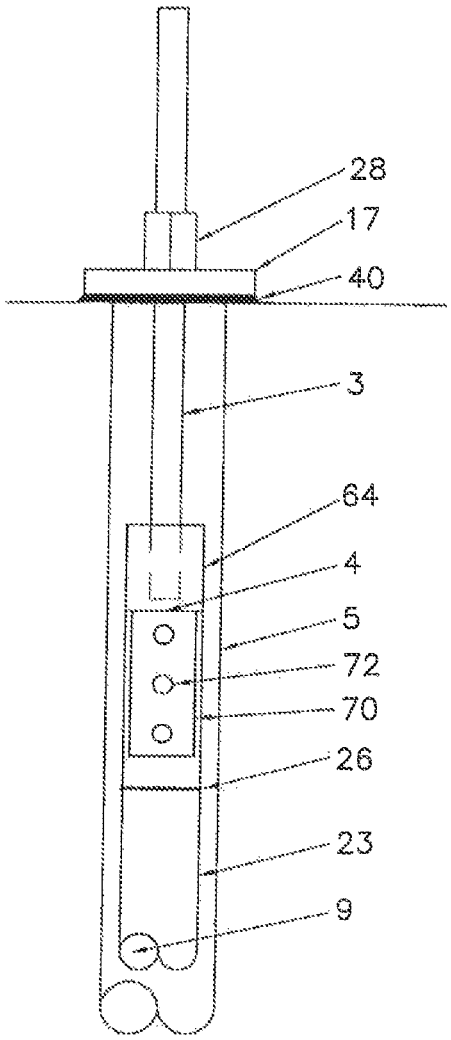
FIG. 8 is an enlarged fragmental view illustrating the upper end of the tension-only bolt helical anchor shown in FIG. 7 including a threaded anchor bolt, plated and nutted at the top and connected to the helical anchor pipe by a subassembly, all within a PVC sleeve.
Figure 8A:
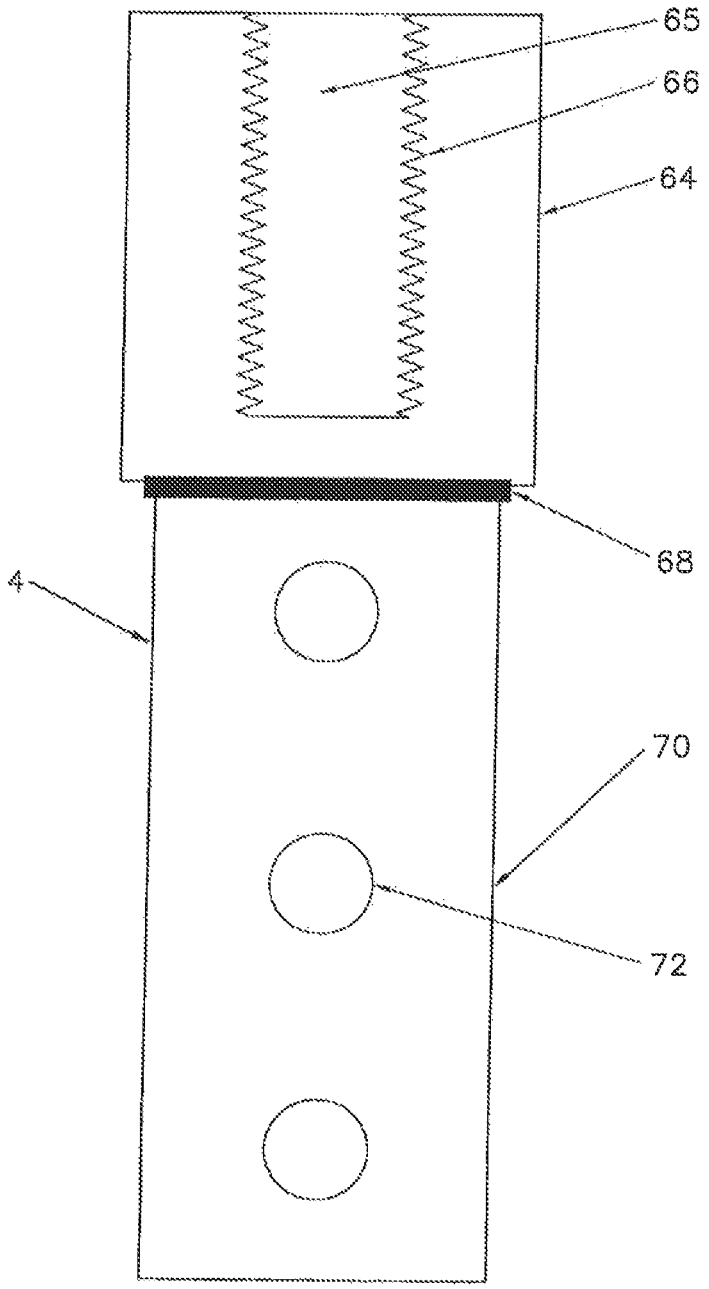
FIG. 8A is an enlarged side view of the subassembly in FIG. 8 which connects the anchor bolt or anchor tendon of the bolt helical anchor at its lower end to the upper end of the helical anchor pipe.
Figure 12:
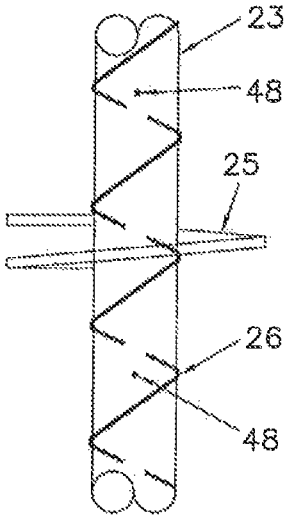
FIG. 12 is an enlarged fragmental view of a helical disc positioned around the helical anchor pipe of the type shown in FIG. 9 with grouting holes and spiral welds around the pipe perimeter.

The helical anchor bolts 3 are sleeved, preferably by PVC tubing 5, through the concrete foundation cap 46 to prevent bonding with the concrete foundation cap 46 and to allow for post-tension stretching. As shown in FIGS. 7 and 8, the subassembly 4 and the top of the anchor pipe 23 are also within the sleeve 5. The portions 16 of the helical anchor pipes 23 below the PVC no-bond zone have drilled holes or grouting ports 48 as well as helical anchor discs 25 welded around the perimeter as shown in FIG. 12. The grouting ports 48 preferably have a diameter of about one-half inch and allow for pressure grouting of the anchor pipes 23 and their surrounding soils with measured quantities and pressures after the helical anchor assembly 47 is spin drilled deep into the ground.

The perimeter surface of the helical anchor pipes 23 is preferably deformed by spiral and inertia welds 26 shown in FIGS. 8, 10, 11 and 12. The spiral and inertia welds 26 increase the strength of the bond between the pipes and the grout that is injected under pressure into the pipe and forced out through the grouting holes 48 in the pipe to surround the exterior of the pipe. The anchor pipe welds may be formed with an arc welder or by other means as would be known by persons of skill in the art.

Figure 14:
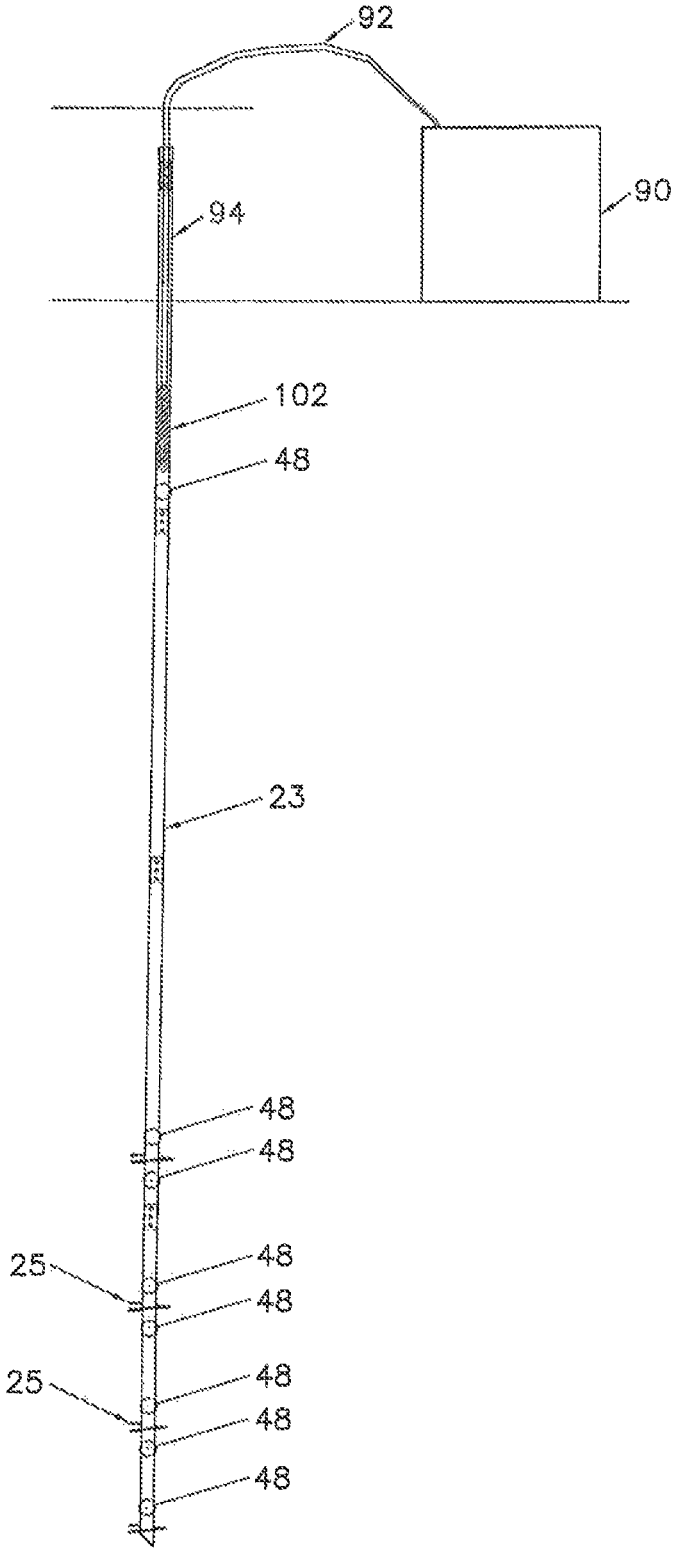
FIG. 14 is a side view of a bolt helical anchor of the type shown in FIG. 9 having a helical anchor pipe with grouting ports in accordance with the first embodiment of the present invention and illustrating a packer and grout pump used to pressure grout the anchor pipe positioned in the excavation or on the ground before the foundation cap is formed.

Pressure grouting of the anchor pipes 23 through the drill holes or grouting ports 48 in the anchor pipes 23 can include the use of a packer 102, as shown in FIG. 14. After the anchor pipes are spin drilled into the ground and before the foundation cap is formed, grout 24, preferably cement or a sand cement slurry material or the like, is injected by a grout pump 90 through a hose 92 and then to a grouting pipe 94 that is connected to the hose 92 and the pipe 23. The injected grout fills the pipe and exudes under injection pressure through the grouting ports 48, preferably positioned adjacent the helical discs 25. Having been forced through the grouting ports 48, the grout then surrounds the outside of the pipe 23 and the helical discs 25, increasing the helical disc bearing and skin friction resistance of the anchor pipe with surrounding soil.

To grout the anchor pipes 23, the packer 102 is inserted into the hollow annulus 9 (see FIGS. 8 and 10) of the helical anchor pipe 23 and inflated to confine pressure-grouting to an area below the packer. The grouting pipe 94 passes through the packer 102 to provide pressurized grout to that portion of the pipe 23 below the packer. After intended quantities and pressures are reached in a lower zone of the helical anchor pipe 23, the packer 102 is deflated, moved upward and reinflated to pressure-grout the next zone above the previous zone. Packers that can be used with the present invention are available from Geopro S. A. of Belgium.

More particularly, the packer 102 is first placed above the lowest grouting ports 48. Grout is injected until a specified pumping pressure is reached at which time the grout volume is recorded. The packer 102 is then moved upwardly above the next set of grouting ports and the pressurized grouting process is repeated. After all grouting ports have been grouted, the subassembly 4 is inserted into the helical anchor pipe 23 with the holes 72 in the rod 70 aligned with corresponding holes in the anchor pipe. Bolts are then inserted through the aligned holes and secured with nuts to securely connect the pipe 23 to the rod 70 of the subassembly 4.

Figure 13:
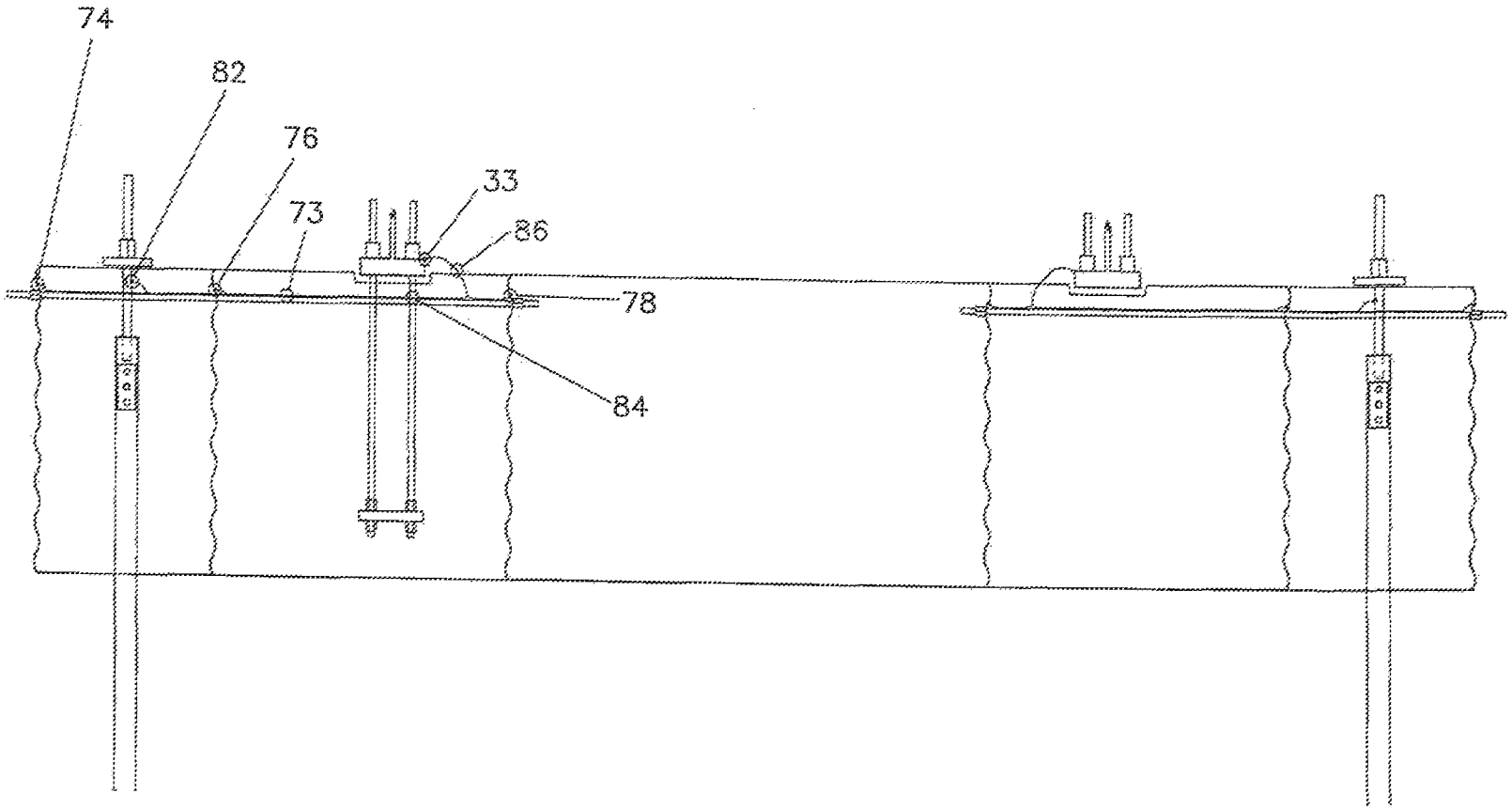
FIG. 13 is a partial sectional view of the foundation can showing a grounding configuration in accordance with the present invention.

As shown in FIG. 13, grounding is provided by a mechanical cable 73 connected to the corrugated metal pipes (CMPs) at 74, 76 and 78, and to subassembly bolts at 82 and tower anchor bolts at 84. In addition, the cable 73 is connected by a copper grounding wire 86 to the tower base flange 33.

Figure 9:
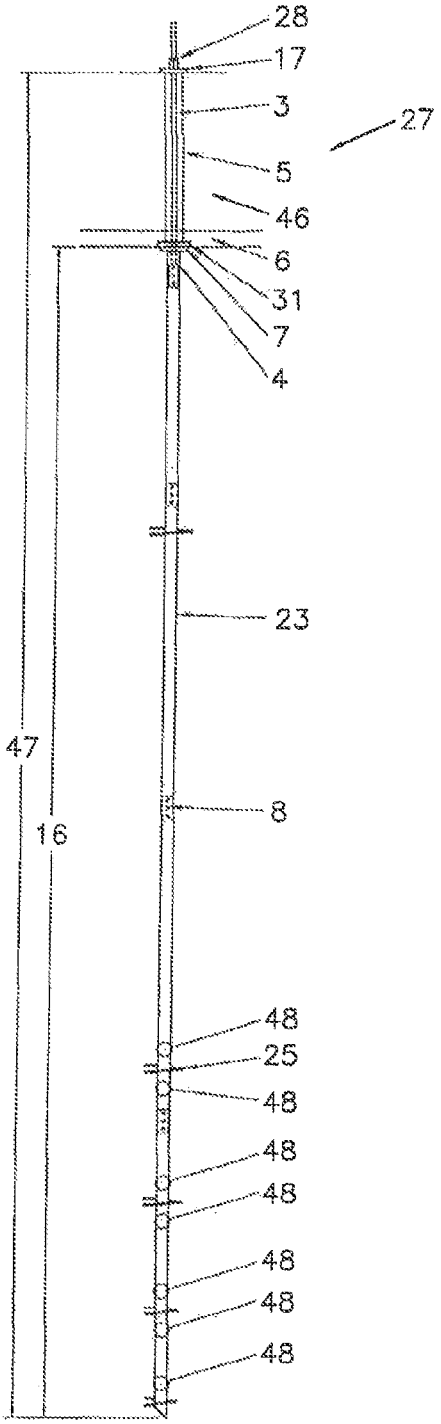
FIG. 9 is a sectional view illustrating a bolt helical anchor configured as a convertible bolt helical anchor to provide both tension and load bearing compression, the upper end extending through the concrete foundation cap with a compression plate in the leveling course below the concrete foundation cap and above the helical anchor pipe.
Figure 10:
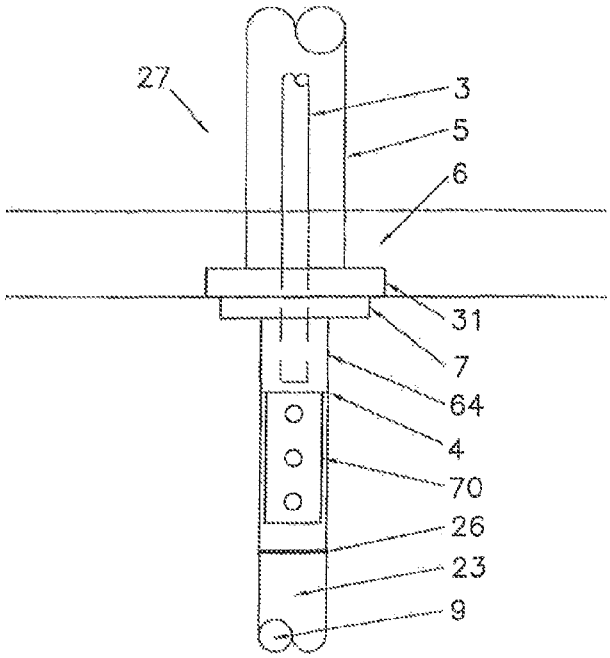
FIG. 10 is an enlarged fragmental view illustrating the convertible helical anchor shown in FIG. 9 with a compression apparatus including a steel plate topped by compressible material and supported below by a subassembly connecting the helical anchor bolt to the helical anchor pipe.

While FIG. 2A shows two bolt helical anchors configured as tension-only members, some of the helical anchor assemblies 47 may be constructed as convertible helical anchors, generally designated by reference numeral 27, as shown at the right of FIG. 25 and in FIGS. 9 and 10. As noted earlier, the convertible helical anchors are configured to provide both tension and load bearing compression. While all of the helical anchors could be constructed as convertible helical anchors, generally approximately only 25% to 50% of the anchors are constructed to be convertible helical anchors 27. When providing for load bearing compression the convertible anchors serve to limit the maximum settlement of the concrete foundation cap 46.

The convertible helical anchors 27 terminate with the subassembly 4 connection to the helical anchor bolts 3 below the leveling course 6 beneath the concrete foundation cap 46. As shown in FIGS. 9 and 10, compression plate 7 is set atop the subassembly 4 with a helical anchor compression disc 31 of Styrofoam or the like set atop the compression plate 7 and extending upward into the leveling course 6. Following concrete pour and cure of the concrete foundation cap 46, the helical anchor base plates 17 are installed over the threaded helical anchor bolts 3 atop the concrete foundation cap 46, and the post-tensioning nuts 28 are torqued or threaded snugly against the helical anchor plates 17 during the post-tensioning jacking of the helical anchor pipe bolts 3 (see FIGS. 2A, 2B, 7, 8 and 9). The convertible anchors act as tension members until the cap settles to reach the compression plate 7 at which point the compressible disc 31 allows the concrete cap foundation 46 to be pulled downwardly, compressing and consolidating the underlying soils to the required bearing strengths and allowing the helical anchors 47 to pull upwardly, developing skin friction resistance equal to the helical anchor pipe bolt or tendon 3 post-tension.

Referring to FIGS. 2A, 2B, 3, and 4, radially extending bolts 34 are positioned horizontally between the pairs of anchor bolts 13, 14 and the helical anchor bolts 3. The radical bolts 34 preferably are placed near both the top and bottom of the concrete foundation cap 46. The radial bolts pass through internal corrugated metal pipes 21 and 22 which provide hoop and vertical steel reinforcement, as well as bolt support before the concrete foundation cap 46 pour is made. The horizontally extending radial bolts 34 are nutted 35 outside the perimeter-defining corrugated metal pipe 20 and inside the innermost corrugated metal pipe 22. While not shown, a plate is preferably positioned between the nut and the outer surface of the corresponding pipe wall to reinforce the pipe wall and distribute the pressure created by the nut upon tightening thereof. The radial bolts 34, which are preferably sleeved, are post-tensioned from the perimeter of the concrete foundation cap 46 following pour and cure of the concrete foundation cap 46. The void 2 between the corrugated metal pipe 20 and the edge of the foundation excavation 29 is backfilled with clean sand or a sand cement slurry 30 after the horizontally extending radial bolts 34 are post-tensioned.

The radial bolts 34 may be steel rods of grade 75 or less, and may alternatively be embodied as cables, known as strands. The strands are typically about 0.5 inches in diameter, with two to three of such strands being wrapped together depending on the strength needed. When strands are used, a sleeve of PVC or other material is not necessary as the strand are generally provided with a rubber sheath from the manufacturer. Nuts are not used to tighten the cables or strands, but rather a specialized tool known as a wedge that has teeth that bite into the cables as they are stretched during post-tensioning such a tool is known to persons of skill in the art. A representative multistrand post-tensioning cable system is the DYWIDAG post-tensioning system available from DYWIDAG Systems International (DSI) having locations worldwide.

The helical anchor bolts 3 used in a tension-only bolt helical anchor are generally between about 2 feet and about 5 feet in length, and preferably about 3 feet in length. The helical anchor bolts 3 used in a convertible bolt helical anchor are approximately 6-8 feet in length. The additional length is needed because the anchor bolts 3 need to extend all the way through the foundation cap.

The second embodiment according to the present invention, i.e., the so-called "hollow bar helical anchor", is shown in FIGS. 15-18. Many of the structural components of the second embodiment are the same as those already described in connection with the first embodiment. Accordingly, description of the components that are common to both embodiments will not be repeated here.

Figure 15:
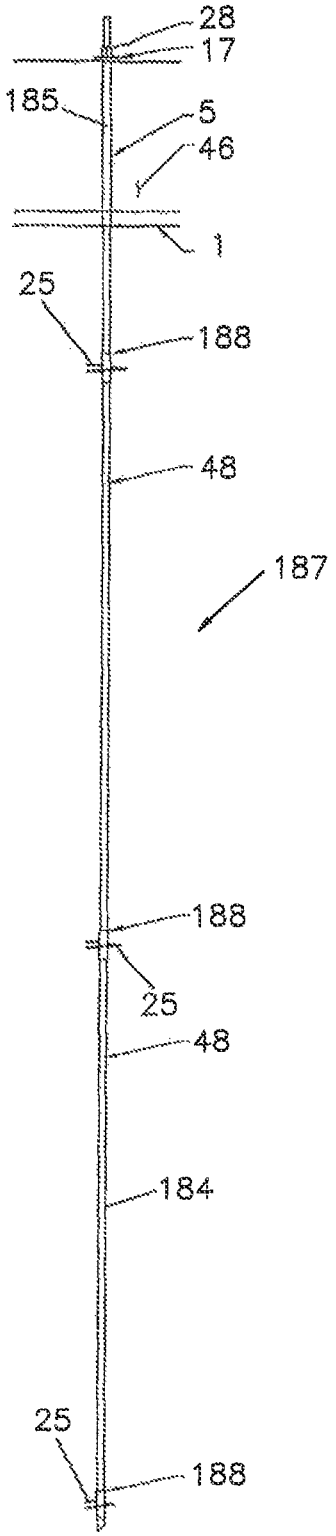
FIG. 15 is a sectional view illustrating a tension-only hollow bar helical anchor according to a second embodiment of the present invention, with the upper end of the hollow bar helical anchor extending through the concrete foundation cap and the lower end including coupled pipe sections having helical discs mounted on the couplers.

FIG. 15 is a sectional view illustrating a tension-only hollow bar helical anchor, generally designated by reference numeral 187, according to the second embodiment. Each hollow bar helical anchor 187 is formed by coupling together lengths of externally threaded hollow bar pipes or anchor rods 184 which are typically sectioned in 5 foot to 20 foot lengths. As in the first embodiment, the lower part of the hollow bar helical anchor 187 includes a hollow bar helical anchor pipe 184 with helical discs 25 welded around the perimeter and grout ports 48 drilled through the couplers connecting lengths of externally threaded hollow bar pipes or anchor rods. For increased friction against the soil, the hollow bar helical anchor pipes 184 do not require spiral or inertia welds as they have exterior rolled threads 127 (3 threads to the inch) which are about ⅛ inch wide and a 16$^{th}$ of an inch high. Hollow bar pipes suitable for use in the second embodiment of the present invention include those manufactured and sold by the Williams Form Engineering Corporation of Belmont, Mich., as part of their Hollow All-Thread Self-Drilling Anchoring System.

The upper portion of the hollow bar helical anchor 187 includes a short length of hollow bar 185 which serves as a tensioning element, with sleeve 5 to prevent adhesion to cementitious material of the foundation cap 46. The sleeved length of hollow bar 5 extends through the foundation cap 46 and is post-tensioned on the upper surface of the cap by nuts 28 in the same manner as the anchor bolts 3 of the first embodiment.

Figure 18:
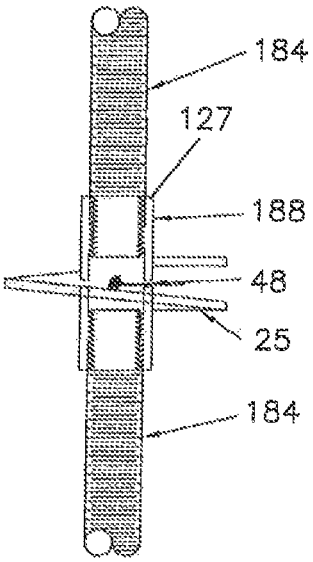
FIG. 18 is an enlarged fragmental view of two lengths of hollow bar helical anchor pipes connected by an internally threaded coupler shown in cross section and having helical discs mounted thereon and grout holes therein in accordance with the second embodiment.

The desired number of pipes or hollow bars are assembled end-to-end with internally threaded bolted couplers 188, best shown in FIG. 18. The internally threaded couplers 188 are approximately 12 inches in length and connect the externally threaded ends of two linearly aligned hollow bar anchor pipes which are received within opposing ends of the coupler as shown in FIG. 18. Once assembled, the coupler 188 is bolted or affixed to each end of bars 184 by any suitable means. The short length of hollow bar 185 is coupled to the upper end of the embedded hollow bar 184 using a coupler 188 in the same manner as the embedded sections of hollow bar are coupled together.

Figure 16:
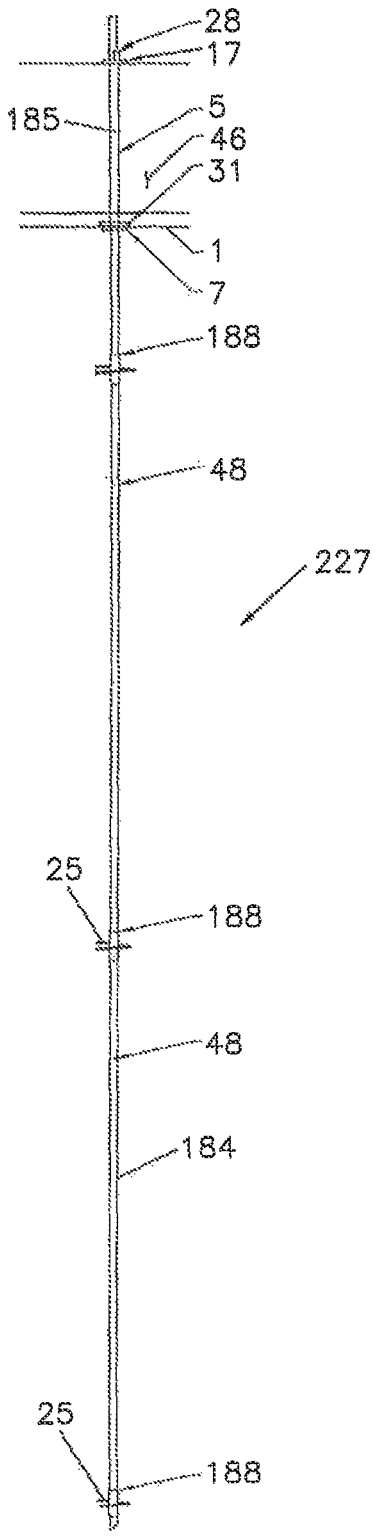
FIG. 16 is a sectional view illustrating a convertible hollow bar helical anchor assembly according to the second embodiment.

FIG. 16 is a sectional view illustrating a convertible hollow bar helical anchor assembly, generally designated by reference numeral 227, according to the second embodiment. Like the first embodiment, the convertible hollow bar helical anchor assembly 227 includes a compression apparatus with an anchor plate 7 topped by a compressible disc 31, with the hollow bar passing through openings in the anchor plate and disc. The short length 185 of hollow her that extends through the cap is coupled to the upper end of the embedded hollow bar 184 using a coupler 188.

Figure 17:
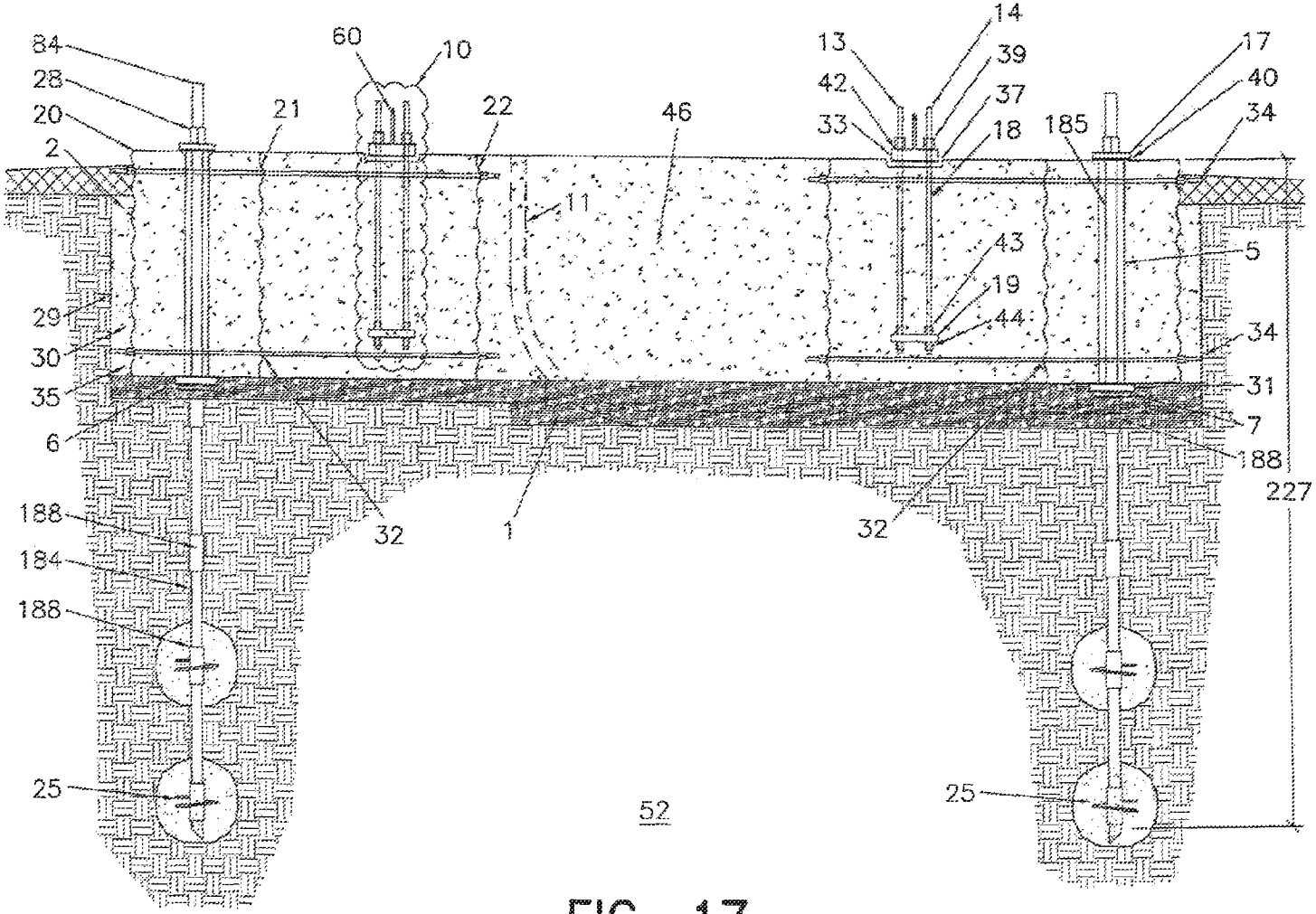
FIG. 17 is a sectional view of a post-tensioned hollow bar helical anchor and foundation cap according to the second embodiment with two convertible hollow bar helical anchors, each having a compression apparatus including a steel plate topped by compressible material and supported below by the coupler at the upper end of the embedded hollow bar anchor pipes at or near ground level.

FIG. 17 shows two convertible hollow bar helical anchors 227 as incorporated within the overall foundation of the present invention. As shown, the anchor plate 7 is supported by the underlying coupler 188 at the upper end of the embedded hollow bar 184 at or near ground level.

Construction Sequence and Special Features for First Embodiment

1. At the desired location, excavate the ground for constructing the circular concrete foundation cap to a depth which allows a minimum of 1 ft. of the circular concrete foundation cap to extend above building pad subgrade. Compact the bottom of the excavation 29.

2. Spin drill the desired number of bolt helical anchor assemblies 47 to the desired depth. The number of bolt helical anchor assemblies 47 typically depends upon the number of tower anchor bolts. Helical anchor pines 23 are sectioned typically in 5 ft. to 20 ft. lengths and bolted together with bolts or studs through bolted couplers 8. The helical anchor discs 25 auger downward into the ground material.

3. Pressure-grout each bolt helical anchor 47 through grout holes or ports 48 in the anchor pipe 23. If desired, the grout can be placed sequentially from the bottom up using a packer 102 (see FIG. 14).

4. Allow the grout 24 of the bolt helical anchor to cure a minimum of twelve (12) hours before the subassemblies 4 are placed and used to attach the helical anchor pipe 23 to threaded helical anchor bolts 3.

5. Excavate a trench below the concrete foundation cap excavation 29 for electrical, communication, and grounding conduits (see FIGS. 2A and 2B), if they are not routed through the concrete foundation cap 46.

6. Install and secure in place the electrical, communication, and grounding conduits (not shown) in trench 11 if under the concrete foundation cap 46. If the electrical, communication, and external grounding conduits are routed between the tower anchor bolts 13 and through the concrete foundation cap 46, place and secure the electrical, communication and external grounding conduits prior to pouring concrete for the concrete foundation cap 46. Place the compression plates 7 atop the subassemblies 4 of the convertible anchors, place the convertible bolt helical anchor compression discs 31 atop the compression anchor plates 7, and place helical anchor bolt PVC pipes 5 or the like atop the discs 31.

7. Place and secure the internal grounding wire 12 to the helical anchor pipes 23. Leave tails for later connection of the internal grounding wire (not shown) to the perimeter corrugated metal pipe 20, the internal corrugated metal pipes 21 and 22, and the supported structural tower base flange 33.

8. Pour the concrete/slurry leveling course 6 and the electrical, communication, and grounding trench 11 if the conduits are routed under the foundation.

9. Assemble the tower anchor bolt cage, generally designated by reference numeral 10 (see FIGS. 2A and 2B) which includes the template ring 15 (see FIG. 1), the embedment ring 19 along with the lap joints 45, tower anchor bolts 13, 14, the hex nut 43 above the embedment ring and the hex nut 44 below the embedment ring. Place, level, and secure the tower anchor bolt cage 10 centered in the concrete foundation cap 46 footprint.

10. Place the perimeter corrugated metal pine 20 and the internal corrugated metal pipes 21 and 22. Drill holes 32 in the corrugated pipes for passing through the horizontally extending radial bolts 34 if the holes were not pre-drifted. Connect the internal grounding wire to the corrugated metal pipes 20, 21 and 22.

11. Insert the sleeved horizontal radial bolts 34 through the holes 32 in the corrugated metal pipes and between the sleeved tower anchor bolts 13, 14. Place nuts 35 on threaded ends beyond the bolt sleeves inside the innermost internal corrugated metal pipe 22 and outside the perimeter corrugated metal pipe 20.

12. Pour concrete and finish concrete foundation cap 46. Remove the template ring 15 for reuse a minimum of one (1) day after concrete cure.

13. After a minimum of three (3) clays of concrete cure, or after concrete cylinder break tests determine a specified concrete strength, tension the horizontally extending radial bolts 34 from outside the perimeter corrugated metal pipe 20.

14. Place and level the helical anchor base plate 17 atop leveling shims (not shown) and a thin layer 40 of cementitious grout (see FIGS. 2A, 2B and 8). After grout cure of a minimum of one (1) day, post-tension the bolt helical anchor assemblies 47. Measure the tension in the threaded helical anchor bolts 3 after post-tensioning all bolts.

15. Install the tower 60 or other structure atop the leveling shims in the grout trough. Pour grout 37 (see Figure under the level tower or structure base flange 33 and post-tension tower anchor bolts 13, 14.

Construction Sequence and Special Features for Second Embodiment

1. At the desired location, excavate the ground for constructing the circular concrete foundation cap to a depth which allows a minimum of 1 ft. of the circular concrete foundation cap to extend above building pad subgrade. Compact the bottom of the excavation 29.

2. Spin drill the desired number of hollow bar helical anchors 187 to the desired depth. The number of hollow bar helical anchor assemblies 187 typically depends upon the number of tower anchor bolts. Hollow bar anchor pipes 184 are sectioned typically in 5 ft. to 20 ft. lengths and bolted together with threaded couplers 188. Helical discs 25 are welded around the pipe and grout ports 48 are drilled through threaded couplers 188.

3. Pressure-grout each hollow bar helical anchor 187 through grout holes or ports 48 in the hollow bar anchor pipe couplers 188. If desired, the grout can be placed sequentially from the bottom up using a packer 102 (see FIG. 14). Alternatively, grouting may be deferred until after the foundation cap is formed, i.e., after step 11 below.

4. Excavate a trench below the concrete foundation cap excavation 29 for electrical, communication, and grounding conduits 11 (see FIG. 15), if they are not routed through the concrete foundation cap 46.

5. Install and secure in place the electrical, communication, and grounding conduits (not shown) in trench 11 if under the concrete foundation cap 46. If the electrical, communication, and external grounding conduits are routed between the tower anchor bolts 13 and through the concrete foundation cap 46, place and secure the electrical, communication and external grounding conduits prior to pouring concrete for the concrete foundation cap 46. For convertible hollow bar helical anchors, place the compression plates 7 atop the coupler on the hollow bar end at or about ground level, place the helical anchor compression discs 31 atop the compression anchor plates 7, and place helical anchor bolt PVC pipes 5 or the like atop the discs 31.

6. Place and secure the internal grounding wire 12 to the hollow bar helical anchor pipes 184. Leave tails for later connection of the internal grounding wire (not shown) to the perimeter corrugated metal pipe 20, the internal corrugated metal pipes 21 and 22, and the supported structural tower base flange 33.

7. Pour the concrete/slurry leveling course 6 and the electrical, communication, and grounding trench 11 if the conduits are routed under the foundation.

8. Assemble the tower anchor bolt cage, generally designated by reference numeral 10 (see FIG. 15) which includes the template ring 15 (see FIG. 1), the embedment ring 19 along with the lap joints 45, tower anchor bolts 13, 14, the hex nut 43 above the embedment ring and the hex nut 44 below the embedment ring. Place, level, and secure the tower anchor bolt cage 10 centered in the concrete foundation cap 46 footprint.

9. Place the perimeter corrugated metal pipe 20 and the internal corrugated metal pipes 21 and 22. Drill holes 32 in the corrugated pipes for passing through the horizontally extending radial bolts 34 if the holes were not pre-drilled. Connect the internal grounding wire to the corrugated metal pipes 20, 21 and 22.

10. Insert the sleeved horizontal radial bolts 34 through the holes 32 in the corrugated metal pipes and between the sleeved tower anchor bolts 13, 14. Place nuts 35 on threaded ends beyond the bolt sleeves inside the innermost internal corrugated metal pipe 22 and outside the perimeter corrugated metal pipe 20.

11. Pour concrete and finish concrete foundation can 46. If grouting was deferred as noted in step 3, pressure-grout each hollow bar helical anchor 187 through grout holes or ports 48 in the anchor pipe 184. If desired, the grout can be placed sequentially from the bottom up using a packer 102. Remove the template ring 15 for reuse a minimum of one (1) day after concrete cure.

12. After a minimum of three (3) days of concrete cure, or after concrete cylinder break tests determine a specified concrete strength, tension the horizontally extending radial bolts 34 from outside the perimeter corrugated metal pipe 20.

13. Place and level the helical anchor base plate 17 atop leveling shims (not shown) and a thin layer 40 of cementitious grout (see FIG. 15). After grout cure of a minimum of one (1) day, post-tension the hollow bar helical anchor assemblies 187.

14. Install the tower 60 or other structure atop the leveling shims in the grout trough. Pour grout 37 (see FIG. 6) under the level tower or structure base flange 33 and post-tension tower anchor bolts 13, 14.

Structural and Operational Advantages of Both Embodiments

The helical anchor foundation of the present invention provides significant structural and operational advantages as follows:

1. The concrete foundation cap 46 is constructed at or below ground surface so the top is elevated above the surrounding ground surface and above shallow temporary flooding, and the bottom of the concrete foundation cap 46 is above ground water.

2. The bolt helical anchors 47 and the hollow bar helical anchors 187 of the helical anchor foundation 52 are tension members which pull the concrete foundation cap 46 downwardly, compressing and improving the strength of the underlying bearing soils with such a compression force that the concrete foundation cap 46 is always bearing on the underlying soils even under the greatest overturning and uplift forces transferred to the concrete foundation cap 46 from the tower structure by the tower anchor bolts 13, 14 connected to the concrete foundation cap 46.

3. The tensioning elements of the post-tensioned helical anchors, whether anchor bolts 3 or the short length of hollow bar 185, are shielded from bonding with the reinforced concrete of the concrete foundation cap 46 by sleeves, allowing the tensioning elements to elongate when pulled upward by jacks to the required post-tension. The post-tensioned anchor bolts or tendons 3 are secured in tension by nuts 28 which are threaded atop the helical anchor base plates 17 against the top of the concrete foundation cap 46, thus pulling the cap 46 downwardly with great compression against the underlying soils. Helical anchor bolts or tendons 3 may be retensioned as necessary using thread nuts 28.

4. The pull down/hold down force of the helical anchors 47, 187 results from the post-tensioning of the anchor bolts 3 or the hollow bar length 185 against the helical anchor base plates 17 atop the concrete foundation cap 46. Each helical anchor 47, 187 is pulled upwardly toward the bottom of the concrete foundation cap 46 until the resisting skin friction along the sides of the helical anchor pipe 23, 184 the compression atop the helical anchor discs 25, and the skin friction of the pressure in grout 24 equals the post-tension on the threaded anchor bolt 3 or hollow bar length 185. The post-tension downward force atop the concrete foundation can 46 by each helical anchor 47, 187 should exceed the determined maximum uplift of the helical anchor by factor or 1.33 or greater.

5. The helical anchors 47, 187 can all be tension-only anchors, but preferably approximately 25 to 50% of the anchors are convertible to also act as compression anchors to limit the maximum settlement of the concrete foundation cap 46. The convertible helical anchors 27, 227 that are constructed to provide both tensions and compression capabilities are made to include compressible material 31 placed in spaces that are cast into the bottom of the leveling course 6 above the steel compression plate 7 supported by the subassembly connecting the threaded anchor bolt 3 to the helical anchor pipe 23 or the coupler 188 positioned just below the plate 7. The compressible material 31 (or space gap) allows the concrete cap foundation 46 to be pulled downwardly, compressing and consolidating the underlying soils to the required bearing strengths and allowing the convertible helical anchors 27, 227 to pull upwardly, developing the skin friction resistance equal to the helical anchor post-tension on the tensioning element.

6. Sleeved horizontally extending radial bolts 34 nutted on the ends provide steel reinforcement near the top and bottom of the concrete foundation cap 46. The sleeved radial bolts are post tensioned to compress the concrete in the concrete foundation cap 46 horizontally. The maximum tensioning forces from bending of the concrete foundation cap 46 eliminate bolt cycling, stress reversals, and fatigue, increasing life expectancy of the foundation. The bolt sleeves of PVC pipe or the like allow the bolts to be replaced to extend fatigue life or to be replaced with greater bolt strength for additions to the supported structure or future replacement with a larger structure. The sleeved radial bolts can extend horizontally beyond the perimeter of the concrete foundation cap and be coupled to extensions of the bolts for increasing the size and load capacity of the foundation.

7. Corrugated metal pipes 20, 21 and 22 are placed in the interior and at the perimeter of the concrete foundation cap 46. The corrugated metal pipes 20, 21, and 22 provide vertical and circumferential steel reinforcement, a perimeter form, and holes therein to support and position the radial sleeved bolts 34 which provide the post-tensioned horizontal steel reinforcement.

8. The helical anchor pipes 23, 184 have holes or grouting ports 48 drilled through the anchor pipe wall to allow pressurized grout or sand cement slurry to be injected into the surrounding soil materials to improve ground conditions and strengths, increasing the skin friction with the helical anchor pipe 23, 184, welds 26 or external threads 127, and helical discs 25, and increasing the size and contact area of the anchor.

9. The bolt helical anchor pipe 23 and the hollow bar helical anchor pipes 184 have a hollow annulus 9 that provides a central vertical void in the helical anchor pipe 23, 184 for high pressure injection of grout 24 through grout holes 48 drilled through the pipe wall. The annulus 9 is filled incrementally using an inflatable packer 102 that plugs the annulus to confine the grouting to zones below the packer. After intended quantities and pressures are reached in a lower zone of the helical anchor pipe 23, 184, the packer is deflated and moved upward to grout a next higher zone.

10. The helical anchor pipes 23 preferably have a deformed outer surface from rough welds 26 that are not ground smooth around the perimeter of the pipe so as to increase friction and bond strength with pressure injected grout 24. The hollow bar helical anchor pipes 184 have an externally threaded surface that increases friction without the need for welds.

11. The constructed helical anchors 47, 187 are designed to allow easy access to determine at any time the residual tension in each helical anchor after relaxation and soil creep by ultrasonic testing. Tension determination demonstrates the helical anchor 47, 187 performance and determines when and which anchors may require maintenance retesting.

12. Installing the bolt helical anchor pipes 23 and/or hollow bar helical anchor pipes 184 is accomplished by spin drilling the anchors with helical discs 25 which auger deep down through the soil or soft rock. No soil or water is removed in connection with the helical anchor assembly 47, 187 installation and therefore environmental permits are not required for dewatering equipment, holding ponds, or disposal sites.

13. The construction of the post-tensioned helical anchors and foundation 52 requires less area and fewer construction materials than shallow foundations which require massive size and material weight to resist supported structural overturn. Therefore, the concrete foundation cap 46 in accordance with the present invention has much smaller carbon footprint and provides environmentally conducive advantages.

14. The grout 37 poured into and confined by the grout trough 41 (see FIG. 4) to support the tower 60 is preferably mixed with rubber tire grindings and/or fiber mesh as grout additives to provide energy dampening of the tower movement.

15. Electrical, communications, and grounding conduits in trench 11 are placed and secured between the tower anchor bolts 13, 14, and extended vertically through the top of the foundation 46 and horizontally through or under the concrete foundation cap 46.

16. The electrical grounding cables are connected to the supported structure base flange 33 and external grounding cables and rods beyond the perimeter of the concrete foundation cap 46. The grounding cables are also tailed (not shown) to connect internally to the corrugated metal pipes 21 and 22, the bolt helical anchor pipes 23 and/or hollow bar helical anchor pipes 184, and the perimeter corrugated pipe 20.

17. The tower anchor bolts 13, 14 connecting supported structure to the concrete foundation can 46 are sleeved with PVC pipe 18 or the like and are secured with nuts 43 atop and nuts 44 below the embedment ring 19 near the bottom of the concrete foundation cap 46. The bolts are replaceable with higher strength bolts of the same size if structure loads are Increased in the future as a result of structure modifications or enlargements.

18. The bolt helical anchor pipes 23 and/or hollow bar helical anchor pipes 184 are drilled deep into the ground beyond weaker shallow soils for seating in stronger and denser soil or soft rock. The deep anchoring provides a foundation support system deep into the ground below potential shallow soil failures from such events as storm surges, seismic upset forces, liquefaction, and flooding.

The foregoing is considered as illustrative only of the principles of the invention. Further, since numerous modifications and changes will readily occur to hose skilled in the art, it is not desired to limit the invention to the exact construction and operation shown and described, and, accordingly, all suitable modifications and equivalents may be resorted to, falling within the scope of the invention.

What is claimed is:

1. A post-tensioned concrete foundation for supporting on its upper surface a tall tower or a structure subject to heavy load and high upset forces, said foundation comprising:

a generally horizontal concrete foundation cap for supporting a tall tower or other structure from an upper surface and having a lower surface engaged with a ground surface; and a plurality of generally vertical post-tensioned hollow bar helical anchors circumferentially spaced from one another, each of said hollow bar helical anchors including at least one hollow bar helical anchor pipe extending downwardly from said concrete foundation cap lower surface into surrounding soil underneath said concrete foundation cap, and a tensioning element coupled to an upper end of said at least one hollow bar helical anchor pipe and extending through the concrete foundation cap, an upper end of each of said tensioning elements terminating above said concrete foundation cap upper surface, said tensioning elements pulling said cap downwardly and pulling the at least one hollow bar helical anchor pipe of each hollow bar helical anchor upwardly to post tension said foundation cap and said hollow bar helical anchors.

2. The post-tensioned concrete foundation of claim 1, wherein said tensioning elements have sleeves to prevent bonding of said tensioning elements with the concrete.

3. The post-tensioned concrete foundation of claim 1, wherein each of said hollow bar helical anchors includes a plurality of hollow bars assembled end-to-end in substantially linear alignment and coupled together at adjoining ends to form said hollow bar helical anchor pipes.

4. The post-tensioned concrete foundation of claim 3, wherein said hollow bar ends are externally threaded and are coupled at said adjoining ends by internally threaded couplers.

5. The post-tensioned concrete foundation of claim 1, wherein the tensioning element of each of said plurality of hollow bar helical anchors is a length of hollow bar.

6. The post-tensioned concrete foundation of claim 4, wherein the tensioning element of each of said plurality of hollow bar helical anchors is a length of hollow bar with a sleeve to prevent bonding of the tensioning element with the concrete.

7. The post-tensioned concrete foundation of claim 6, wherein an uppermost hollow bar of said hollow bar helical anchor pipe is coupled to said hollow bar tensioning element with an internally threaded coupler.

8. The post-tensioned concrete foundation of claim 6, wherein said couplers have grout holes formed therein.

9. The post-tensioned concrete foundation of claim 8, wherein each of said helical anchor pipes has helical discs on a perimeter thereof.

10. The post-tensioned concrete foundation or claim 9, wherein said hollow bar helical anchor pines are pressure-grouted to force grout through the grout holes where the grout surrounds the pipes and the helical discs increasing a pull-out resistance of the hollow her helical anchor pipes with surrounding soil.

11. The post-tensioned concrete foundation of claim 1, further comprising an anchor plate surrounding an upper end of each tensioning element and a tension nut threaded onto said tensioning element upper end to retain elongation of said hollow bar helical anchors upon post-tensioning thereof.

12. The post-tensioned concrete foundation of claim 11, wherein said anchor plate is supported by an underlying coupler at an upper end of said hollow bar helical anchor pipe at or near ground level.

13. The post-tensioned concrete foundation of claim 1, wherein a percentage of the hollow bar helical anchors is convertible to compression elements with a compressible material placed atop a steel plate in cementitious material below the concrete foundation cap to limit the maximum downward movement of the concrete foundation cap.

14. The post-tensioned concrete foundation of claim 13, wherein the compressible material is a Styrofoam disc larger than the underlying steel plate.

15. The post-tensioned concrete foundation of claim 1, wherein corrugated metal pipes are positioned interior to and around the perimeter of the concrete foundation cap, said corrugated metal pipes providing vertical and circumferential steel reinforcing, and a perimeter form for precast or cast in place versions of the concrete foundation cap.

16. The post-tensioned concrete foundation of claim 15, wherein sleeved radial bolts extend horizontally through the concrete foundation can and are nutted against the interior of the inside corrugated metal pipe and the exterior of the perimeter corrugated metal pipe, said sleeved radial bolts being post tensioned after the concrete foundation cap has been poured and cured by tensioning the bolts with hydraulic jacks and torquing the nuts around the per of the concrete foundation cap to secure the tension in said radial bolts.

17. The post-tensioned concrete foundation of claim 16, wherein said corrugated metal pipes have positioning and supporting holes near the top and bottom for the radial bolts.

18. The post-tensioned concrete foundation of claim 16, wherein the radial bolts extend horizontally beyond the perimeter of the concrete foundation cap allowing future coupling on of additional bolt extensions to increase the diameter of said cap or other foundation additions or connections to accommodate enlargement of or a larger supported structure.

19. A concrete foundation for supporting on its upper surface a tower or a structure in clays, sands, and other soft ground surface which can be water-bearing and/or too weak to stand or maintain a formed excavation, said foundation comprising:

a concrete foundation can for supporting the tower or other structure from an upper surface and having a lower surface; and a plurality of hollow bar helical anchors circumferentially spaced from one another around said concrete foundation cap, each of said hollow bar helical anchors including a plurality of hollow bars coupled to one another end to end in substantially linear alignment, at least an uppermost hollow bar extending through the concrete foundation cap and terminating above said concrete foundation cap upper surface, hollow bars positioned below said uppermost hollow bar extending downwardly from said concrete foundation cap lower surface and being embedded into surrounding soil underneath said concrete foundation cap, said embedded hollow bars including a plurality of grout holes and being pressure grouted with cementitious material through an interior of said embedded hollow bars and around a perimeter thereof to improve soil strength and increase the bond between the embedded hollow bars and the surrounding soil and thereby increase the foundation loading capacity and stiffness.

20. The concrete foundation as set forth in claim 19, wherein the uppermost hollow bar is a tensioning element by which the hollow bar helical anchors are post-tensioned.

21. A post-tensioned concrete foundation for supporting on its upper surface a tall tower or a structure subject to heavy load and high upset forces, said foundation comprising:

a concrete foundation can for supporting a tall tower or other structure from an upper surface and having a lower surface; and a plurality of post-tensioned hollow bar helical anchors formed from a plurality of hollow bars or anchor rods coupled end-to-end, said anchors having a lower portion extending downwardly from said concrete foundation cap lower surface into surrounding soil underneath said concrete foundation cap, and a sleeved hollow bar at an upper end of said lower portion serving as a tensioning element and extending through the concrete foundation cap and terminating above said concrete foundation cap upper surface, said tensioning element being post-tensioned to pull said cap downwardly and pull said hollow bar helical anchors upwardly to post-tension said foundation cap and said helical anchors.

22. The post-tensioned concrete foundation of claim 21, wherein said hollows bars are connected end to end with couplers, said couplers having grout holes and helical discs adjacent said grout holes.

* * * * *